US010567880B2

(12) United States Patent
Ham et al.

(10) Patent No.: US 10,567,880 B2
(45) Date of Patent: Feb. 18, 2020

(54) DISPLAY APPARATUS

(71) Applicant: LG Display Co., Ltd., Seoul (KR)

(72) Inventors: Sungsu Ham, Bucheon-si (KR); SeYoung Kim, Bucheon-si (KR); Sungtae Lee, Bucheon-si (KR); Kwangho Kim, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/110,281

(22) Filed: Aug. 23, 2018

(65) Prior Publication Data

US 2019/0098411 A1 Mar. 28, 2019

(30) Foreign Application Priority Data

Sep. 27, 2017 (KR) ..... 10-2017-0124918

(51) Int. Cl.

| | |
|---|---|
| ***H04R 7/04*** | (2006.01) |
| ***H04R 1/02*** | (2006.01) |
| ***H04R 9/06*** | (2006.01) |
| *H04R 17/00* | (2006.01) |
| *H04R 9/02* | (2006.01) |

(52) U.S. Cl.

CPC ..... *H04R 7/045* (2013.01); *H04R 1/025* (2013.01); *H04R 9/06* (2013.01); *H04R 9/025* (2013.01); *H04R 17/00* (2013.01); *H04R 2499/15* (2013.01)

(58) Field of Classification Search

CPC .... H04R 2499/15; H04R 7/045; H04R 1/028; H04R 2499/11; H04R 17/00; H04R 2440/00; H04R 2440/05; H04R 2440/07; H04R 17/005; H04R 7/04; H04R 7/26; H04R 2207/00; H04R 2207/021; H04R 2307/201; G06F 1/1688; G06F 1/1605; H04N 5/642

See application file for complete search history.

(56) References Cited

U.S. PATENT DOCUMENTS 9,681,217 B2 * 6/2017 Mihelich ..... H04R 1/2857

* cited by examiner

*Primary Examiner* — Kile O Blair

(74) *Attorney, Agent, or Firm* — Morgan, Lewis & Bockius LLP

(57) ABSTRACT

A display apparatus includes: a display panel configured to display an image by emitting light; a supporting member configured to support a rear surface of the display panel; a partition between the display panel and the supporting member; and a sound generation device configured to vibrate the display panel to generate sound, the sound generation device including: a first sound generator on the rear surface of the display panel; and a second sound generator in the first sound generator.

27 Claims, 19 Drawing Sheets

DISPLAY APPARATUS

CROSS-REFERENCE TO RELATED APPLICATION(S)

This application claims the benefit of and priority to Korean Patent Application No. 10-2017-0124918, filed on Sep. 27, 2017, the entirety of which is hereby incorporated by reference.

BACKGROUND

1. Technical Field

The present disclosure relates to a display apparatus, and more particularly, to a display apparatus that vibrates a display panel to generate sound.

2. Discussion of the Related Art

With the advancement of an information-oriented society, various requirements for the display field of expressing information in accordance with an electrical information signal are increasing. Thus, research is being conducted on various display apparatuses that are thin, light, and have low power consumption. For example, display apparatuses include a liquid crystal display (LCD) apparatus, a field emission display (FED) apparatus, an organic light-emitting display apparatus, etc.

Among the above display apparatuses, the LCD apparatus may include an array substrate including a thin film transistor (TFT), an upper substrate including a color filter and/or a black matrix, and a liquid crystal layer between the array substrate and the upper substrate. An alignment state of the liquid crystal layer is controlled based on an electric field applied to two electrodes in a pixel region, whereby light transmittance is adjusted based on the alignment state of the liquid crystal layer, thereby displaying an image.

The organic light-emitting display apparatus, which is a self-light emitting display device, has advantages in fast response speed, high light-emitting efficiency, high luminance, and a wide viewing angle in comparison with other display apparatuses. Thus, these apparatuses are attracting much attention.

A display apparatus may display an image, and an additional separate speaker for supplying sound generally has to be provided. If the speaker is provided in the display apparatus, the sound generated in the speaker advances toward a lower or rear portion of the display panel, instead of toward a front portion of the display panel. Thus, the sound does not advance toward the front portion of the display panel, i.e., toward a user who watches the image displayed on the display panel, which may be disruptive to a user's immersion experience.

In addition, when the sound generated in the speaker advances toward the lower or rear portion of the display panel, sound quality is deteriorated due to interference with sound reflected on the wall or floor. Furthermore, when the speaker is included in a set apparatus, such as a television (TV), the speaker occupies a space, which may impose a restriction on design and a spatial disposition of the set apparatus.

SUMMARY

Accordingly, the present disclosure is directed to a display apparatus that substantially obviates one or more of the issues due to limitations and disadvantages of the related art.

An aspect of the present disclosure is to provide a display apparatus including a sound generation device for generating sound that may travel to a front direction of a display panel.

Another aspect of the present disclosure is to provide a display apparatus including a sound generation device that has a reduced size and may output an enhanced sound.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a display apparatus, including: a display panel configured to display an image by emitting light; a supporting member configured to support a rear surface of the display panel; a partition between the display panel and the supporting member; and a sound generation device configured to vibrate the display panel to generate sound, the sound generation device including: a first sound generator on the rear surface of the display panel; and a second sound generator in the first sound generator.

In another aspect, there is provided a display apparatus, including: a display panel configured to display an image by emitting light, the display panel including: a first region, a second region, and a third region, a supporting member configured to support a rear surface of the display panel, and at least one sound generation device including: a first sound generator in at least one of the first region, the second region, and the third region, and a second sound generator in the first sound generator.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1A:
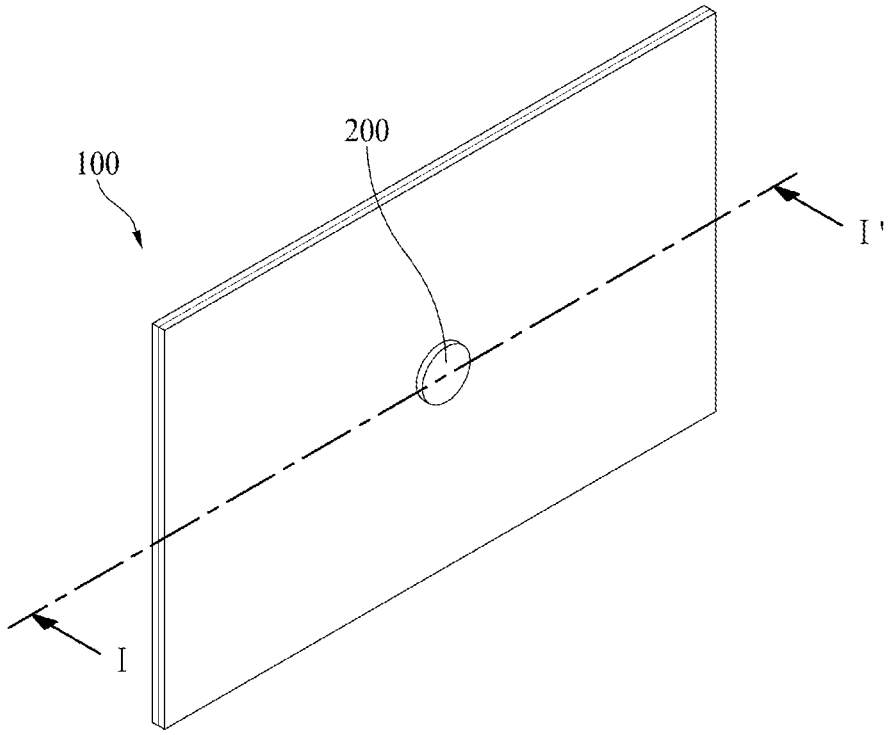
FIG. 1A illustrates a display apparatus including a sound generation device according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, when a position relation between two parts is described as, for example, "on," "over," "under," or "next," one or more other parts may be disposed between the two parts unless a more limiting term, such as "just" or "direct(ly)," is used.

In describing a time relationship, when the temporal order is described as, for example, "after," "subsequent," "next," or "before," a case which is not continuous may be included unless a more limiting term, such as "just," "immediate(ly)," or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms like "first," "second," "A," "B," "(*a*)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

In the present disclosure, examples of a display apparatus is used to encompass a display apparatus such as an organic light emitting display module (OLED module) or a liquid crystal module (LCM), that includes a display panel and a driving unit for driving the display panel. The display apparatus is used to further encompass a set device (or a set apparatus) or a set electronic apparatus, as a finished product, such as a notebook computer or a laptop computer, a television set, a computer monitor, an equipment apparatus (e.g., display equipment in an automotive apparatus or another type of vehicle apparatus) or a mobile electronic apparatus that is a complete product or a final product (for example, a smartphone or an electronic pad, etc.) that includes the LCM or the OLED module. Therefore, in the present disclosure, the display apparatus is used display apparatus itself, such as the LCM or the OLED module, and also a set apparatus which is a final consumer apparatus or an application product including the LCM or the OLED module.

In some example embodiments, the LCM or the OLED module including a display panel and a driving unit thereof may be referred to as a display apparatus, and the electronic apparatus as a final product including the LCM or the OLED module may be referred to as a set apparatus. For example, the display apparatus may include a display panel, such as an LCD or an OLED, and a source printed circuit board (PCB) as a controller for driving the same. The set apparatus may further include a set PCB that is a set controller set to be electrically connected to the source PCB and to control the overall operations of the set apparatus.

A display panel applied to an embodiment may use any type of display panel, such as a liquid crystal display panel, an organic light emitting diode (OLED) display panel, and an electroluminescent display panel, but is not limited to these specific types. For example, the display panel of the present disclosure may be any panel capable of being vibrated by a sound generation device according to embodiments of the present disclosure to output sound. A shape or a size of a display panel applied to a display apparatus according to embodiments of the present disclosure is not limited.

For example, if a display panel is a liquid crystal display panel, the display panel may include a plurality of gate lines, a plurality of data lines, and a plurality of pixels respectively provided in a plurality of pixel areas at intersections of the gate lines and the data lines. Also, the display panel may include an array substrate including a thin film transistor (TFT), which is a switching element for adjusting a light transmittance of each of the plurality of pixels, an upper substrate including a color filter and/or a black matrix, and a liquid crystal layer between the array substrate and the upper substrate.

In addition, if a display panel is an organic light-emitting display panel, the display panel may include a plurality of gate lines, a plurality of data lines, and a plurality of pixels respectively provided in a plurality of pixel areas defined by intersections of the gate lines and the data lines. The display panel may include an array substrate including a TFT, which is an element for selectively applying a voltage to each of the pixels, an organic light emitting device layer on the array substrate, and an encapsulation substrate disposed on the array substrate to cover the organic light emitting device layer. The encapsulation substrate may protect the TFT and the organic light emitting device layer from an external impact, and may prevent moisture or oxygen from penetrating into the organic light emitting device layer. A layer provided on the array substrate may include an inorganic light-emitting layer (for example, a nano-sized material layer, a quantum dot, or the like). The display panel may further include a backing such as a metal plate attached to the rear surface of the display panel, but the backing is not limited to the metal plate, and another structure may be included.

In the present disclosure, the display panel including a sound generation device may be implemented at a user interface module in a vehicle, such as the central control panel area in an automobile. For example, such a display panel may be configured between two front seat occupants, such that sounds due to a vibration of the display panel propagate towards the interior of the vehicle. As such, the audio experience within a vehicle can be improved as compared to having speakers at the interior sides or edges of the vehicle.

The inventors have recognized the above-described problems and have conducted various experiments so that, when watching an image in front of a display panel, a traveling direction of sound becomes a direction toward a front portion of the display panel. Thus, sound quality is enhanced. Through the various experiments, the inventors have invented a display apparatus having a new structure, which facilitates output of sound so that a traveling direction of sound becomes a direction toward a front portion of a display panel, thereby enhancing sound quality.

Hereinafter, a display apparatus according to an embodiment of the present disclosure will be described in detail with reference to the accompanying drawings.

FIG. 1A illustrates a display apparatus including a sound generation device according to an embodiment of the present disclosure.

With reference to FIG. 1A, a display apparatus may include a display panel 100, which may display an image, and a sound generation device 200 that may vibrate the display panel 100 to generate sound. The sound generation device 200 may be on the rear surface of the display panel 100. The sound generation device 200 may be referred to, for example, as an "actuator," an "exciter," or a "transducer," but embodiments are not limited thereto.

Figure 1B:
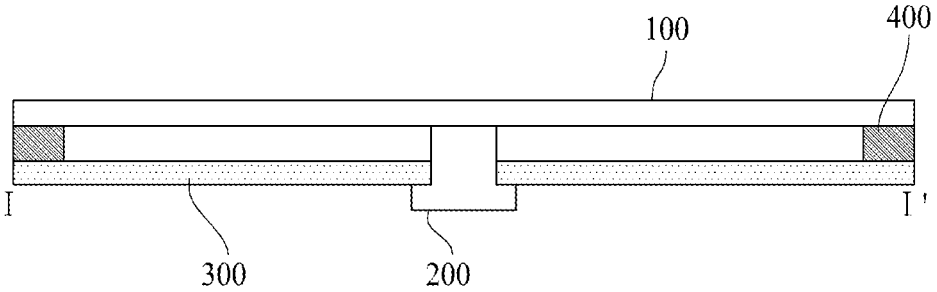
FIG. 1B is a cross-sectional view taken along line I-I' of FIG. 1A.

FIG. 1B is a cross-sectional view taken along line I-I' of FIG. 1A.

With reference to FIG. 1B, the display apparatus may include the sound generation device 200 and a supporting member 300. The supporting member 300 may support one or more of a rear surface and a side (or lateral) surface of the display panel 100. Also, the sound generation device 200 may be fixed to the supporting member 300.

The supporting member 300 may be, for example, a cover bottom. Alternatively, the supporting member 300 may further include a middle cabinet, which may be connected to a cover bottom, and which may surround the side surface of the display panel 100, may accommodate one periphery of the display panel 100, and may accommodate one periphery of the display panel 100 to support the display panel 100. For example, the middle cabinet may include a "–|"-shaped (or T-shape at a 90-degree angle) cross-sectional surface. The supporting member 300 may include the cover bottom, or may include the cover bottom and the middle cabinet, but embodiments are not limited thereto. For example, the supporting member 300 may include any structure that may cover the rear surface or the side surface of the display panel 100. Moreover, the supporting member 300 may be a plate member provided over the rear surface of the display panel 100, or all over the display panel 100.

The supporting member 300 may be referred to as a "cover bottom," a "plate bottom," a "back cover," a "base frame," a "metal frame," a "metal chassis," a "chassis base," or an "m-chassis." Therefore, the supporting member 300 may be a supporter for supporting the display panel 100, and may be implemented as any type of frame or plate-shaped structure, and may be at the rear surface of the display apparatus.

An adhesive member 400 may be in a periphery of each of the display panel 100 and the supporting member 300, and may attach the display panel 100 to the supporting member 300. The adhesive member 400 may include a double-sided tape, but embodiments are not limited thereto.

Figure 2A:
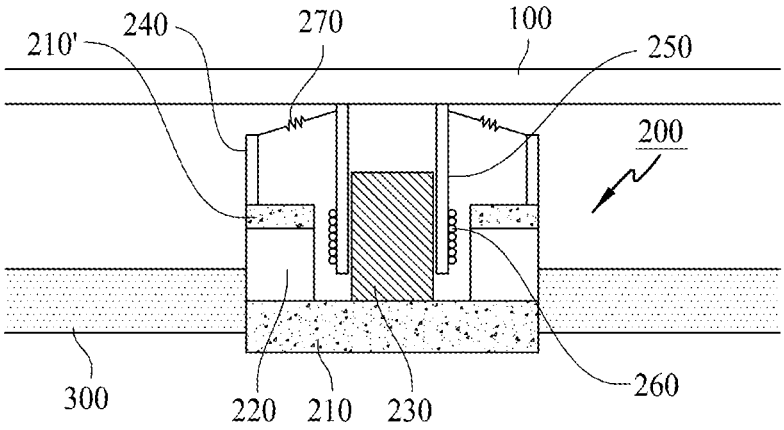
FIGS. 2A and 2B are cross-sectional views of a sound generation device according to an embodiment of the present disclosure.
Figure 2B:
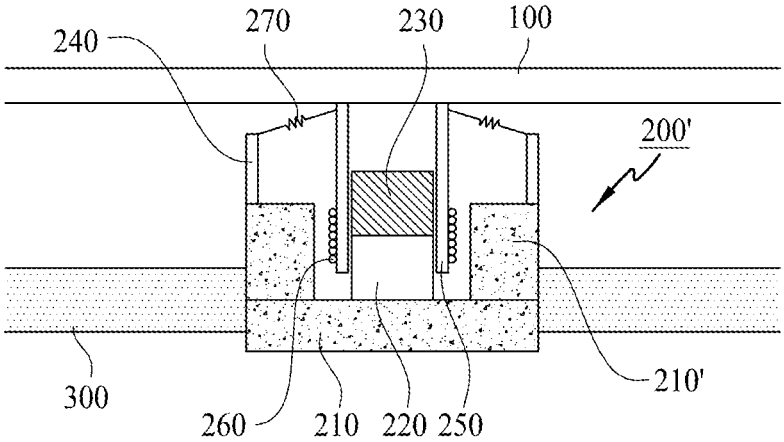

FIGS. 2A and 2B are cross-sectional views illustrating a sound generation device according to an embodiment of the present disclosure.

The sound generation device may be classified into a first structure in which a magnet is disposed outside a coil, and a second structure in which a magnet is disposed inside a coil. The first structure may be referred to as a "dynamic" type or an "external magnetic" type. The second structure may be referred to as a "micro" type or an "internal magnetic" type. FIG. 2A illustrates the first structure, and FIG. 2B illustrates the second structure.

FIG. 2A illustrates the first structure in which a magnet is outside a coil. With reference to FIG. 2A, a sound generation device 200 may include a plurality of plates 210 and 210', a magnet 220 on a corresponding plate, a center pole 230 on a corresponding plate, a bobbin 250 near the center pole 230, and a coil 260 wound around the bobbin 250.

For example, the magnet 220 may be on a first plate 210, and a second plate 210' may be on the magnet 220. The first plate 210 and the second plate 210' may support the magnet 220, and may fix the sound generation device 200 to a supporting member 300. Therefore, the first plate 210 may be fixed to a supporting hole provided in the supporting member 300, and the magnet 220 (between the first plate 210 and the second plate 210') may be fixed and supported between the first plate 210 and the second plate 210'.

At least one of the first plate 210 and the second plate 210' may be formed of a material having magnetism, such as iron (Fe), although embodiments are not limited thereto. The first plate 210 and the second plate 210' are not limited to the term "plate." For example, they may be referred to by another term, such as a "yoke."

The magnet 220 may be implemented, e.g., with a sintered magnet with a material, such as barium ferrite. A material of the magnet 220 may include one or more of: ferric oxide ($Fe_2O_3$), barium carbonate (or witherite) ($BaCO_3$), a neodymium (Nd) magnet, strontium ferrite ($Fe_{12}O_{19}Sr$), e.g., with an improved magnet component, an alloy cast magnet including aluminum (Al), nickel (Ni), and cobalt (Co), and the like. As another example, the neodymium magnet may be neodymium-iron-boron (Nd—Fe—B). However, embodiments are not limited to these examples.

A frame 240 may be disposed outside the first plate 210 and on the second plate 210'. A center pole 230 may be disposed in a center region of the first plate 210. The center pole 230 and the first plate 210 may be provided as one body. The center pole 230 may be referred to as "pole pieces." In one example, pole pieces may be additionally disposed on the center pole 230.

Moreover, the bobbin 250 may surround the center pole 230. The coil 260 may be wound on a lower outer area, for example, a lower outer surface of the bobbin 250, and a current or voice signal for generating sound may be applied to the coil 260.

The bobbin 250 may be a ring-shaped structure that may be formed, e.g., of paper, an aluminum (Al) sheet, and/or the like. The coil 260 may be wound around a certain area of the lower region of the bobbin 250. The bobbin 250 and the coil 260 may be referred to as a "voice coil."

Moreover, a damper 270 may be between some area of an upper portion of the bobbin 250 and the frame 240. The damper may be referred to by another term, such as an "edge."

FIG. 2B illustrates the second structure where a magnet is disposed inside a coil. With reference to FIG. 2B, a sound generation device 200' having the second structure may include a magnet 220 on a first plate 210, a center pole 230 on the magnet 220, a bobbin 250 near the magnet 220 and the center pole 230, and a coil 260 wound around the bobbin 250.

For example, the first plate 210 may be fixed to a supporting hole provided in the supporting member 300. The magnet 220 may be on the first plate 210, and the center pole 230 may be on the magnet 220. The center pole 230 may be referred to as "pole pieces." For example, pole pieces may be additionally provided on the center pole 230.

Moreover, the bobbin 250 may surround the magnet 220 and the center pole 230. The coil 260 may be wound around the bobbin 250. A second plate 210' may be on the first plate 210, and a frame 240 may be outside the periphery of the second plate 210'. Also, a damper 270 may be between the frame 240 and the bobbin 250. In comparison to the first structure in which the magnet is outside the coil, the second structure having the internal magnet has advantages of small leakage magnetic flux and decreased total size of the sound generation device.

The sound generation device used for the display apparatus according to an embodiment of the present disclosure is not limited to the structures of the FIGS. 2A and 2B examples. For example, any sound generation device capable of generating the sound by vibrating, e.g., directly vibrating the display panel, may be applied.

Figure 3A:
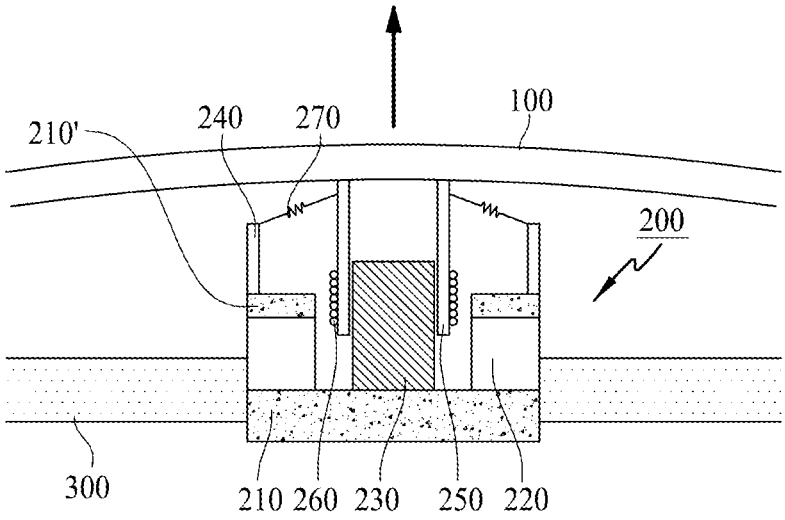
FIGS. 3A and 3B illustrate a sound generating method of the sound generation device with a first structure according to an embodiment of the present disclosure.
Figure 3B:
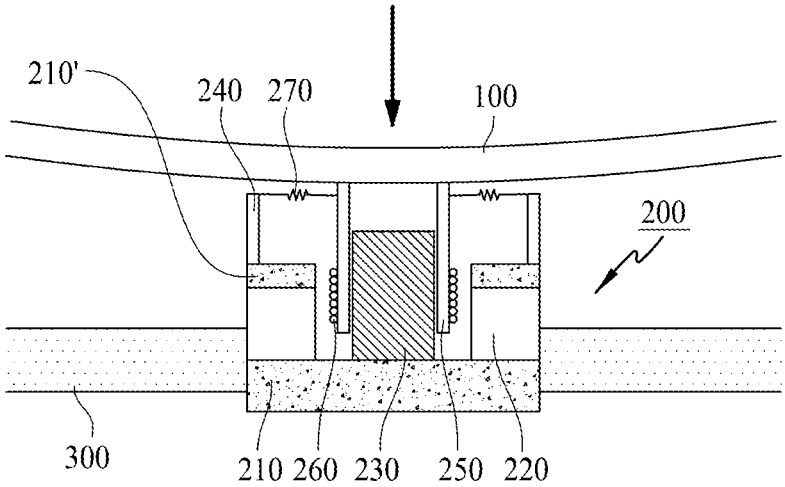

FIGS. 3A and 3B illustrate a sound generating operation method of a sound generation device with a first structure according to an embodiment of the present disclosure.

FIG. 3A illustrates a state in which a current is applied. The center pole 230 connected to a bottom of the magnet 220 may become a north (N) pole, and the second plate 210' connected to an upper portion of the magnet 220 may become a south (S) pole. Thus, an external magnetic field may be generated around the coil 260.

In this state, if the current for generating a sound is applied to the coil 260, an applied magnetic field is formed around the coil 260, and a force for upwardly moving the bobbin 250 may be generated by the applied magnetic field and the external magnetic field. For example, when the current is applied to the coil 260, the magnetic field may be generated around the coil 260, and the external magnetic field may be generated by the magnet 220, whereby the entire bobbin 250 may be guided and may move upward by the center pole 230 according to Fleming's Left-Hand Rule for Motors based on the generated magnetic field and the external magnetic field generated by the magnet 220.

Accordingly, as one surface of the bobbin 250 may contact a rear surface of the display panel 100, the bobbin 250 may vibrate the display panel 100 in an upward direction (illustrated as an arrow) according to whether or not the current is applied to the coil 260, and a sound wave (or sound) is generated by the vibration of the display panel 100. In this state, when the current stops or a reverse current is applied, as shown in FIG. 3B, a force for downwardly moving the bobbin 250 may be generated, similar to the principle described with reference to FIG. 3A, and the display panel 100 may vibrate in a downward direction (illustrated as an arrow).

The damper 270 may be between the frame 240 and some portion of an upper side of the bobbin 250. The damper 270 may have a wrinkled structure, e.g., having elasticity, and the damper 270 may control (or dampen) the up-and-down vibration of the bobbin 250 by contraction and relaxation movements in accordance with the up-and-down movement of the bobbin 250. That is, the damper 270 may be connected to the bobbin 250 and the frame 240, and the up-and-down vibration of the bobbin 250 may be controlled by a restoring force of the damper 270. For example, when the bobbin 250 vibrates by a certain height or more or vibrates by a certain height or less, the bobbin 250 may be restored to its original position by the restoring force of the damper 270.

Therefore, the display panel 100 may vertically vibrate based on an application direction and level of a current applied to the coil 260. A sound wave may be generated by the vibration.

Figure 4A:
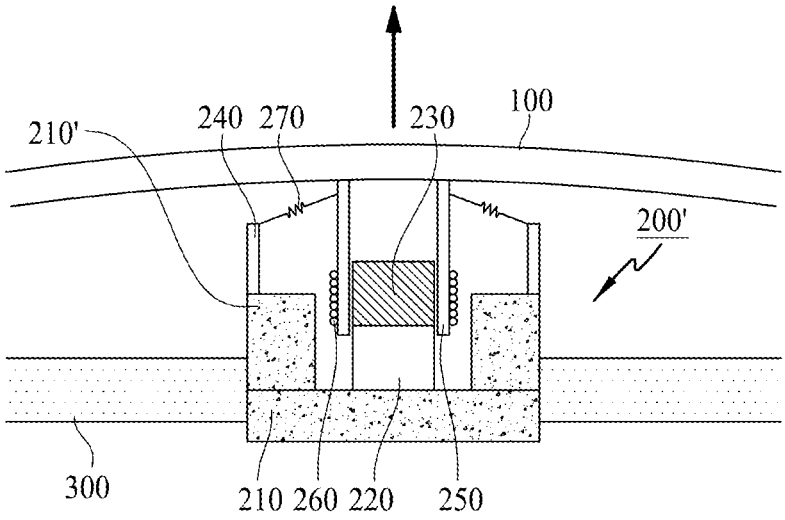
FIGS. 4A and 4B illustrate a sound generating method of the sound generation device with a second structure according to an embodiment of the present disclosure.
Figure 4B:
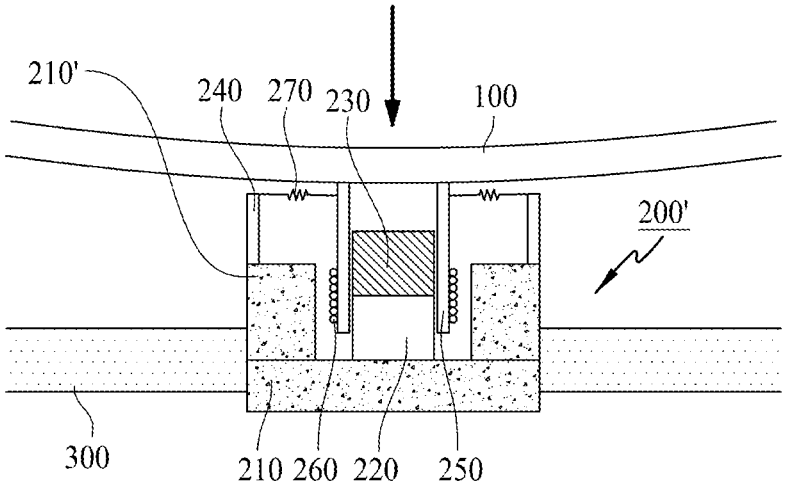

FIGS. 4A and 4B illustrate a sound generating operation method of a sound generation device with a second structure according to an example embodiment of the present disclosure.

FIG. 4A illustrates a state in which a current is applied. The second plate 210' becomes an S-pole, and the center pole 230 connected to an upper surface of the magnet 220 becomes an N-pole, whereby an external magnetic field may be generated between coils 260. The S-pole and the N-pole may be interchanged. If so, the sound generation device may similarly operate by changing a winding direction of the coil 260. In this state, when a current for generating a sound is applied to the coil 260, an applied magnetic field may be generated around the coil 260, whereby a force for upwardly moving the bobbin 250 to an upper side may be generated by the applied magnetic field and the external magnetic field. For example, when the current is applied to the coil 260, the magnetic field may be generated around the coil 260. Thus, the bobbin 250 may be guided by the center pole 230 according to Fleming's Left-Hand Rule for Motors based on the generated magnetic field and the external magnetic field generated by the magnet 220.

Accordingly, as one surface of the bobbin 250 may contact a rear surface of the display panel 100, the bobbin 250 may vibrate the display panel 100 in an upward direction (illustrated as an arrow) according to whether or not the current is applied to the coil 260, and a sound wave (or sound) may be generated by the vibration of the display panel 100. In this state, when the application of the current stops or a reverse current is applied, as shown in FIG. 4B, a force for moving the bobbin 250 to a lower side may be generated according to principles similar to the above description with reference to FIG. 4A, and the display panel 100 may be vibrated in a downward direction (illustrated as an arrow).

The damper 270 may be between the frame 240 and some portion of an upper side of the bobbin 250. The damper 270 may have a wrinkled structure, having elasticity, whereby the damper 270 may control the up-and-down vibration of the bobbin 250 by contraction and relaxation movements in accordance with the up-and-down movement of the bobbin 250. That is, the damper 270 may be connected to the bobbin 250 and the frame 240, and the up-and-down vibration of the bobbin 250 may be controlled (or dampened) by a restoring force of the damper 270. For example, when the bobbin 250 vibrates by a particular height or more, or vibrates by a particular height or less, the bobbin 250 may be restored to an original position by the restoring force of the damper 270. Accordingly, the display panel 100 may be vibrated in the up-and-down direction in accordance with the direction and level of the current applied to the coil 260, to thereby generate a sound wave by the vibration.

Figure 5:
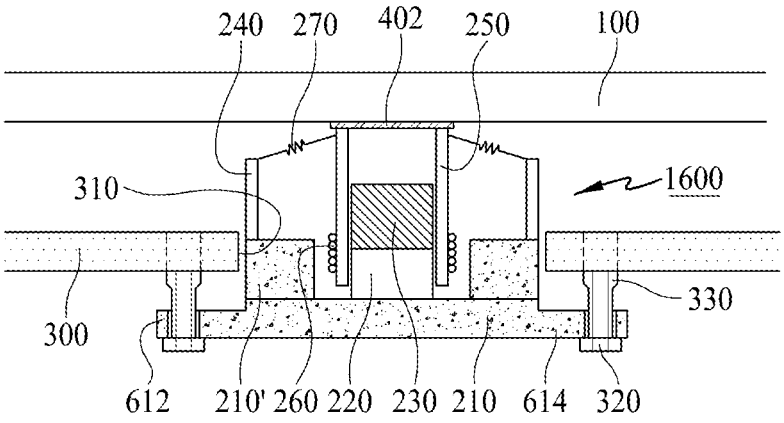
FIG. 5 illustrates a connection structure of a supporting member and a sound generation device according to an embodiment of the present disclosure.

FIG. 5 illustrates a connection structure of a supporting member and a sound generation device according to an embodiment of the present disclosure.

An embodiment of the present disclosure may be applied to both the first and the second structures of the sound generation device as illustrated in the examples of FIGS. 2A and 2B. Hereinafter, an example of the second structure of the sound generation device, e.g., the FIG. 2B example, will be described in detail.

With reference to FIG. 5, a display apparatus may include a display panel 100, a sound generation device 1600, and a supporting member 300. The supporting member 300 may support one or more of a rear surface and a side (or lateral) surface of the display panel 100. The supporting member 300 may be a plate-shaped member, e.g., of a metal or a plastic material, over a rear surface or an entire surface of the display panel 100.

The sound generation device 1600 may be accommodated in a supporting hole 310 of the supporting member 300. If the sound generation device 1600 is inserted into and fixed to the supporting hole 310, it may be possible to decrease or reduce a height of the sound generation device 1600 between the rear surface of the display panel 100 and an inner surface of the supporting member 300, to thereby realize a relatively small space or area for generating the sound.

For example, the sound generation device 1600 may include a diameter enlargement part 614. The diameter enlargement part 614 may be formed as one body with the first plate 210 of the sound generation device 1600. The first plate 210 of the sound generation device 1600 may not have a cylindrical shape. Herein, one portion of the first plate 210 may have a protrusion larger than a diameter of the other portion of the first plate 210. The protrusion portion having an enlarged diameter may be referred to as the diameter enlargement part 614. The diameter enlargement part 614 may have a ring shape. An extension portion 612 for fixation of the sound generation device 1600 may be formed in a portion of the diameter enlargement part 614.

In the extension part 612, there may be a screw 310 and a nut 330. By use of the nut 330 fixed to the supporting member 300, the sound generation device 1600 may be coupled or connected to the supporting member 300 by the screw 320. For example, the nut 330 may be a self-clinching nut. One example of the self-clinching nut is a PEM® nut, but embodiments are not limited thereto.

If using the self-clinching nut, some of the vibration generated in the sound generation device 1600 may be absorbed by the self-clinching nut. Thus, a vibration transferred to the supporting member 300 may be reduced.

In the display apparatus according to an embodiment of the present disclosure, the supporting member 300 and the sound generation device 1600 may be fixed to each other by the nut 300 and the screw 320 in the supporting member 300. Thus, a thickness of the display panel 100 can be reduced.

The display panel 100 may be attached to the bobbin 250 of the sound generation device 1600 by an adhesive member 402. The adhesive member 402 may be a double-sided tape, a single-sided tape, an adhesive, and/or a bond, but embodiments are not limited to these examples. As shown in the FIG. 5 example, the adhesive member 402 may be provided on a periphery portion in which the sound generation device 1600 may be adhered to the display panel 100, but embodiments are not limited to this structure. The adhesive member 402 may be provided on a whole rear surface of the display panel 100. For example, the adhesive member 402 may be on an entire surface between the display panel 100 and the sound generation device 1600.

Further, an adhesive member may be in a periphery of the display panel 100 and the supporting member 300, to thereby adhere the display panel 100 and the supporting member 300 to each other. The adhesive member may include a double-sided tape, a single-sided tape, an adhesive, a bond, and/or the like, but embodiments are not limited thereto.

Figure 6:
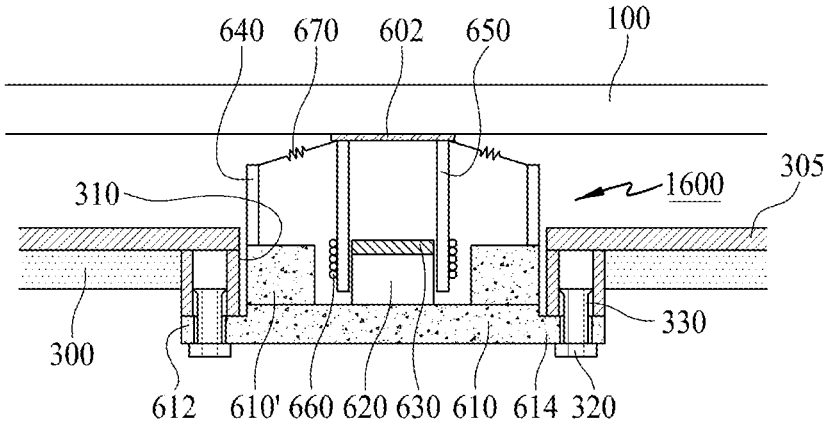
FIG. 6 illustrates a connection structure of a supporting member and a sound generation device according to an embodiment of the present disclosure.

FIG. 6 illustrates a connection structure of a supporting member and a sound generation device according to an embodiment of the present disclosure.

An embodiment of the present disclosure may be applied to both the first and the second structures of the sound generation device as illustrated in the examples of FIGS. 2A and 2B. Hereinafter, an example of the second structure of the sound generation device, e.g., the FIG. 2B example, will be described in detail.

With reference to the example of FIG. 6, the sound generation device 1600 may include a magnet 620 on a first plate 610, a center pole 630 on the magnet 620, a bobbin 650 disposed around the magnet 620 and the center pole 630, and a coil 660 wound on an outer surface of the bobbin 650. For example, a second plate 610' may be on the periphery of the first plate 610. Also, a frame 640 may be on the periphery of the second plate 610'. Also, a damper 670 may be between the frame 640 and the bobbin 650. The FIG. 6 example of the sound generation device 1600 is substantially similar to that of the examples of FIGS. 2A and 2B, and duplicate description for the sound generation device 1600 will be omitted.

The sound generation device 1600 may further include a diameter enlargement part 614. The diameter enlargement part 614 may be formed as one body with the first plate 610 of the sound generation device 1600. The first plate 610 of the sound generation device 1600 may be a cylinder shape. Herein, one portion of the first plate 610 may have a protrusion portion larger than a diameter of the remaining area of the first plate 610. The protrusion portion having a relatively large diameter may be referred to as the diameter enlargement part 614. The diameter enlargement part 614 may have a ring shape. An extension portion 612 for fixation of the sound generation device 1600 may be formed in a particular portion of the diameter enlargement part 614.

In the extension portion 612, there may be a screw 320 and a nut 330. For example, the nut 330 may be a self-clinching nut. One example of the self-clinching nut is a PEM® nut, but embodiments are not limited thereto. The sound generation device 1600 may be fixed to a first supporting member 300 by the screw 320 and the nut 330.

If using the self-clinching nut to connect the first supporting member 300 and the sound generation device 1600 with each other, some of the vibration generated in the sound generation device 1600 may be absorbed in the self-clinching nut, e.g., to reduce the vibration transferred to the first supporting member 300. If supporting member 300 and the sound generation device 1600 are directly connected to each other without using the self-clinching nut, the vibration generated for an operation of the sound generation device 1600 may be transferred to the first supporting member 300 when operated for a long period of time. In this case, if the supporting member 300 has a small thickness, the first supporting member 300 might be bent or deformed. For example, if the first supporting member 300 is thin, the sound generation device 1600 may be directly connected to the screw 320 of the first supporting member 300. Thus, a fixing strength between the first supporting member 300 and the sound generation device 1600 may be insufficient.

Accordingly, if the nut 330 is provided to fix the sound generation device 1600 to the supporting member 300, it may be desired to increase a thickness of the supporting member 300 to avoid or prevent the supporting member 300 from being bent or deformed and to improve a fixing strength between the supporting member 300 and the sound generation device 1600. The increased thickness of the supporting member 300 may cause an increase in the overall thickness of the display apparatus. If the supporting member 300 is formed of glass or stainless steel, e.g., for improving an appearance design of the display apparatus, it may be impossible to insert the nut 330 into the supporting member 300.

Therefore, a second supporting member 305 may be further provided on the first supporting member 300 to insert the nut 330 into the first supporting member 300. The second supporting member 305 may be closer to the display panel 100 than the first supporting member 300.

The second supporting member 305 may be formed of, e.g., a metal material, and the nut 330 may be capable of being inserted into the second supporting member 305. By using the nut 330 fixed to the supporting member 300, the sound generation device 1600 may be connected to the first supporting member 300 and the second supporting member 305 by the screw 320. The first supporting member 300 and the second supporting member 305 may be fixed and adhered to each other by the adhesive member 400. The adhesive member 400 may be a double-sided tape, a single-sided tape, an adhesive, and/or a bond, but embodiments are not limited thereto. In one example, the second supporting member 305 may be formed of a metal material, for example, aluminum (Al), but embodiments are not limited thereto. The second supporting member 305 may be referred to as an "inner plate."

The first supporting member 300 may be glass, stainless steel, and/or the like. Thus, an appearance design of a display apparatus may be improved. Accordingly, as the second supporting member 305 may be additionally provided, the sound generation device 1600 may be tightly adhered to a front surface of the display panel 100 by the thickness of the first supporting member 300. Thus, the thickness of the display apparatus may be decreased. Accordingly, the additionally-provided second supporting member 305 may enable a decrease in the thickness of the sound generation device 1600, thereby decreasing the thickness of the overall display apparatus.

For example, the thickness of the sound generation device 1600 may be decreased by the second supporting member 305, thereby overcoming a problem related to the increased thickness or height of the supporting plate for covering the sound generation device 1600. Thus, the sound generation device 1600 and signal lines may be under the supporting plate, thereby providing a display apparatus with a good exterior design.

An adhesive member 602 may attach the display panel 100 to the sound generation device 1600. The adhesive member 602 may be a double-sided tape, a single-sided tape, an adhesive, a bond, and/or the like, but embodiments are not limited thereto. As shown in the FIG. 6 example, the adhesive member 602 may be in a particular area in which the sound generation device 1600 is attached to the display panel 100, but embodiments are not limited to this example structure. The adhesive member 602 may be provided on an entire (or whole) rear surface of the display panel 100. For example, the adhesive member 602 may be on an entire (or whole) surface between the display panel 100 and the sound generation device 1600.

Figure 7:
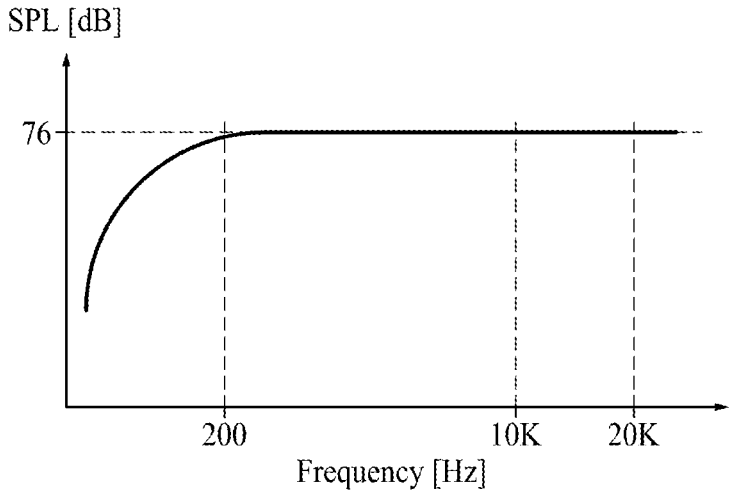
FIG. 7 illustrates a sound output characteristic according to an embodiment of the present disclosure.

FIG. 7 illustrates a sound output characteristic according to an embodiment of the present disclosure.

With reference to FIG. 7, a sound output characteristic according to the embodiment of each of FIGS. 5 and 6 has been measured. In FIG. 7, the abscissa axis (x-axis) represents a frequency in hertz (Hz), and the ordinate axis (y-axis) represents a sound pressure level (SPL) in decibels (dB).

A sound output characteristic shown in FIG. 7 may be measured by a sound analysis apparatus. The sound analysis apparatus may include a sound card for receiving sound from a control personal computer (PC) and transmitting sound to the control PC, an amplifier for amplifying the sound (signal) generated from the sound card and transmitting the amplified sound to the sound generation device 1600, and a microphone for collecting the sound generated in the display panel through the sound generation device 1600. The sound collected in the microphone is provided to the control PC through the sound card, and then the control PC checks the provided sound, and analyzes the sound of the sound generation device 1600.

As shown in FIG. 7, it can be seen that a sound output characteristic appears at 200 Hz or more, corresponding to a middle-pitched sound band. Also, it can be seen that a sound output characteristic appears at 3 kHz or more, corresponding to a high-pitched sound band.

If a size of a sound generation device is designed to be small, e.g., for decreasing a size (for example, a height or a thickness) of the sound generation device, a performance of a sound may be avoided or prevented from being reduced. To avoid or prevent a performance of a sound from being reduced, a size (for example, a size of a coil or a size of a bobbin) of an external diameter of the sound generation device may be designed to be large. This will be described below with reference to FIG. 8.

Figure 8:
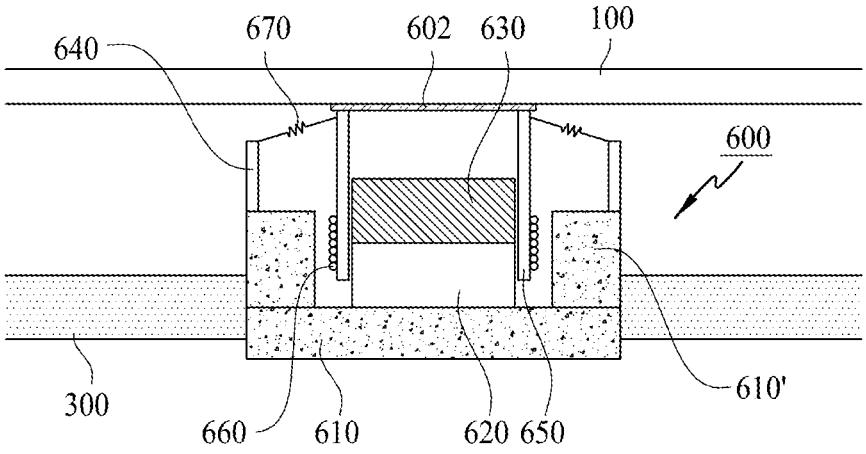
FIG. 8 illustrates a display apparatus according to an embodiment of the present disclosure.

FIG. 8 illustrates a display apparatus according to an embodiment of the present disclosure.

With reference to FIG. 8, a sound generation device 600 may include plates 610 and 610', a magnet 620 on and the plate 610, a center pole 630 on the plate 610, a bobbin 650 near the center pole 630, and a coil 660 around the bobbin 650. The coil 660 may be wound around the bobbin 650. A description of the sound generation device 600 is substantially similar to that of the FIG. 2 example, and a duplicate description for the sound generation device will be omitted. Although the FIG. 8 illustrates the second structure of the FIG. 2B example, the first structure of the FIG. 2A example may also be applied.

To design a sound generation device having a smaller size, a diameter of a bobbin configuring the sound generation device may be greater than that of a bobbin. For example, a diameter of the bobbin may be about 25π units, e.g., millimeters (mm), and a diameter of the bobbin 650 of the FIG. 8 example may be about 40π units, e.g., millimeters (mm). However, embodiments are not limited thereto. A sound output characteristic relevant thereto will be described below with reference to FIG. 9.

Figure 9:
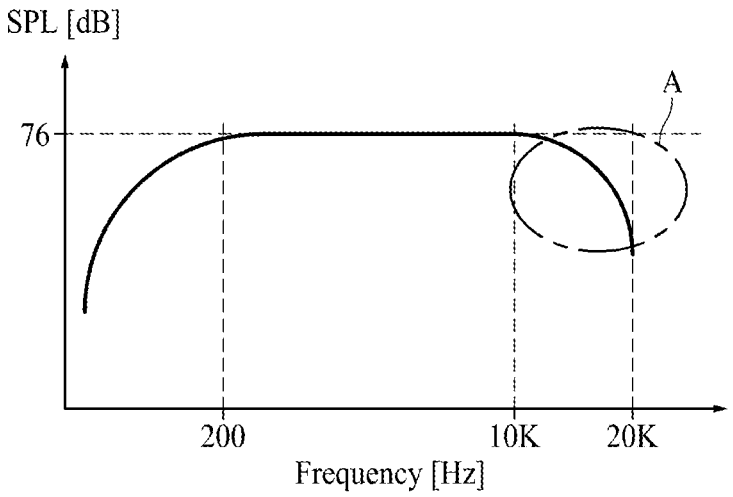
FIG. 9 illustrates a sound output characteristic according to another embodiment of the present disclosure.

FIG. 9 illustrates a sound output characteristic according to an embodiment of the present disclosure.

In the FIG. 9, the abscissa axis (x-axis) represents a frequency in hertz (Hz), and the ordinate axis (y-axis) represents a sound pressure level (SPL) in decibels (dB). A method of measuring a sound output characteristic is substantially similar to that of the FIG. 7 example.

As shown in the FIG. 9 example, when a diameter of a bobbin is set to be large, it can be seen that a sound may be reduced (shown by region A) at the high-pitched sound band. For example, it can be seen that a sound may be reduced at 10 kHz or more.

Therefore, the inventors have performed various experiments for developing a sound generation device which has a reduced size (for example, a reduced thickness or height), and may not reduce a sound having the high-pitched sound band. Based on the various experiments, the inventors have invented a sound generation device having a new structure, which has a reduced size (for example, a reduced thickness or height), and may not reduce a sound having the high-pitched sound band. This will be described below with reference to the examples of FIGS. 10 to 19C.

Figure 10:
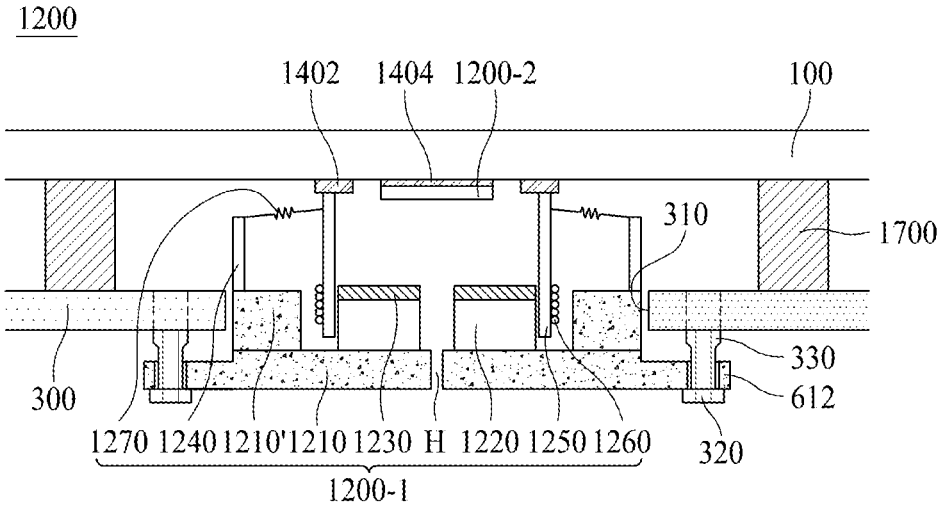
FIG. 10 illustrates a display apparatus according to an embodiment of the present disclosure.

FIG. 10 illustrates a display apparatus according to an embodiment of the present disclosure.

With reference to FIG. 10, a sound generation device 1200 including a first sound generator 1200-1 and a second sound generator 1200-2 may be on a rear surface of a display panel 100. The first sound generator 1200-1 may be a magnetic circuit, and the second sound generator 1200-2 may be a piezoelectric vibrator. In FIG. 10, the first sound generator 1200-1 is illustrated as having the second structure of the FIG. 2B example, but the first structure of the FIG. 2A example may also be applied. The description given above with reference to the examples of FIGS. 5 and 6 may be applied to a connection structure of the first sound generator 1200-1 and a supporting member 300.

Moreover, the first sound generator 1200-1 may include plates 1210 and 1210', a magnet 1220 the plate 1210, a center pole 1230 on the plate 1210, a bobbin 1250 near the center pole 1230, and a coil 1260 around the bobbin 1250. The coil 1260 may be wound around the bobbin 1250. A diameter of the bobbin 1250 may be set to be large, and for example, may be about 40π to 50π units, e.g., millimeters (mm). However, embodiments are not limited thereto.

A frame 1240 may be on the second plate 1210' along the periphery of the first plate 1210. A damper 1270 may be between the frame 1240 and some portion of an upper portion of the bobbin 1250. The damper may be expressed by another term such as an "edge."

The supporting member 300 may be on a rear surface of the display panel 100. In an extension portion 612, there may be a screw 320 and a nut 330. By using the nut 330 fixed to the supporting member 300, the first sound generator 1200-1 may be connected with the supporting member 300 by the screw 320. For example, the nut 330 may be a self-clinching nut. One example of the self-clinching nut is a PEM® nut, but embodiments are not limited thereto.

The first sound generator 1200-1 may be attached to the supporting member 300 by the adhesive member. The adhesive member may include a double-sided tape, a single-sided tape, an adhesive, a bond, and/or the like, but embodiments are not limited thereto.

The first sound generator 1200-1 may be attached to the rear surface of the display panel 100 by a first adhesive member 1402. The first adhesive member 1402 may include a double-sided tape, a single-sided tape, an adhesive, a bond, and/or the like, but embodiments are not limited thereto. Also, the first adhesive member 1402 may be in a particular portion in which the first sound generator 1200-1 may be attached to the display panel 100, but embodiments are not limited thereto. The first adhesive member 1402 may be provided on an entire (or whole) rear surface of the display panel 100. For example, the first adhesive member 1402 may be provided on the entire (or whole) surface between the display panel 100 and the first sound generator 1200-1.

To decrease a size (for example, a thickness or a height) of the sound generation device 1200, a diameter of the first sound generator 1200-1 may be set to be large. A diameter of the first sound generator 1200-1 may be greater than that of the second sound generator 1200-2. Also, the second sound generator 1200-2 may be in or over the first sound generator 1200-1. For example, the second sound generator 1200-2 may be in or over a center of the bobbin 1250 of the first sound generator 1200-1. Therefore, to complement a sound having the high-pitched sound band caused by an increase in a diameter of the first sound generator 1200-1, the second sound generator 1200-2 may be in the first sound generator 1200-1. Therefore, a slim structure may be implemented by decreasing a size (for example, a thickness or a height) of a sound generation device, thereby providing a display apparatus for reducing or preventing a sound having the high-pithed sound band from being reduced. Also, a size (for example, a thickness or a height) of a sound generation device may be reduced, thereby providing a display apparatus having a reduced size.

The second sound generator 1200-2 and the first sound generator 1200-1 may be on a same axis. The second sound generator 1200-2 may be a coaxial speaker. For example, the second sound generator 1200-2 may be a coaxial sound generator in which a first sound generator for outputting a sound having a low-pitched sound band and a second sound generator for outputting a sound having a high-pitched sound band are on the same axis. Therefore, a sound having the high-pitched sound band and the same phase may be reproduced by using the first sound generator for outputting a sound having the low-pitched sound band and the second sound generator for outputting a sound having the high-pitched sound band.

Moreover, the second sound generator 1200-2 may be configured with a piezoelectric vibrator. The piezoelectric vibrator may be a piezoelectric element.

The piezoelectric element may be an element having properties (e.g., a piezoelectric effect) in which, when an external force is applied, electrical polarization occurs to cause a potential difference, but when a voltage is applied, deformation or stress occurs. According to an embodiment, the piezoelectric element may be formed of crystal, tourmaline, Rochelle salt (potassium sodium tartrate tetrahydrate), barium titanate ($BaTiO_3$), ammonium dihydrogen phosphate (or monoammonium phosphate) ($NH_4H_2PO_4$), piezoceramics, and/or the like. Embodiments are not limited to these examples.

The piezoelectric element may be formed by sintering a material having a piezoelectric effect. The piezoelectric element may be formed of an insulation elastic material, such as silicon, acryl, or urethane, or may be a piezoelectric polymer material such as polyvinylidene fluoride (PVDF) or PZT (lead zirconate titanate; a generic name for zirconate $PbZrO_3$ and titanate $PbTiO_3$). PVDF may include polyvinylidene fluoride trifluoroethylene (PVDF-TrFE), and may have a characteristic that is easy to manufacture in a flexible film form.

Therefore, the piezoelectric element may have a structure where the piezoelectric element, including an electrode, is attached to both surfaces of a metal vibration plate or a polymer, e.g., by using an adhesive. A shape of the piezoelectric element may be deformed by applying an alternating current (AC) voltage to both surfaces of the piezoelectric element, and a sound may be generated by transferring the shape deformation of the piezoelectric element to a vibration plate.

A piezoelectric speaker using the piezoelectric element may be categorized into a film-type piezoelectric speaker and a stacked-type piezoelectric speaker. The film-type piezoelectric speaker uses the principle in which an electrode is formed of a piezoelectric film material in each of an upper portion and a lower portion, and a sound may be generated by applying a voltage. The stacked-type piezoelectric speaker may include a plurality of layers, including a piezoelectric element between two electrodes. An AC voltage may be applied between the two electrodes, and the stacked-type piezoelectric speaker may be bent upward and downward according to the AC voltage. The piezoelectric element may use the above-described materials, but embodiments are not limited thereto. The piezoelectric vibrator according to an embodiment of the present disclosure may use any of the film-type piezoelectric speaker and the stacked-type piezoelectric speaker.

The second sound generator 1200-2 may be attached to the display panel 100 by a second adhesive member 1404. The second adhesive member 1404 may include a double-sided tape, a single-sided tape, an adhesive, a bond, and/or the like, but embodiments are not limited thereto.

A wiring for applying a signal to the second sound generator 1200-2 may be provided. The wiring may be in a groove or a hole H in the first sound generator 1200-1, but embodiments are not limited thereto. For example, the wiring may be in a groove or a hole in the supporting member 300. Also, the wiring may be in a groove or a hole in the first plate 1210 to the center pole 1230.

A partition 1700 may be near the rear surface of the display panel 100. For example, the partition 1700 may be between the display panel 100 and the supporting member 300. Also, the partition 1700 may be between the rear surface of the display panel 100 and the supporting member 300.

The partition 1700 may be an air gap or a space in which a sound may be generated when the display panel 100 may be vibrated by the sound generation device 1200. An air gap or a space that generates or transfers a sound may be referred to as a "partition." A partition may be referred to as an "enclosure" or a "baffle," but the term is not limited thereto. The partition 1700 may be a whole area of four outer sides of the rear surface of the display panel 100. Also, the partition 1700 may be a sealed structure, or may be an unsealed structure.

The partition 1700 may be formed of polyurethane, polyolefin, polyethylene, and/or the like, but embodiments are not limited thereto. Also, the partition 1700 may include a double-sided tape, a single-sided tape, an adhesive, a bond, and/or the like, and for example, may be formed of a material having an elasticity that may enable compression to be formed to some extent.

Figure 11:
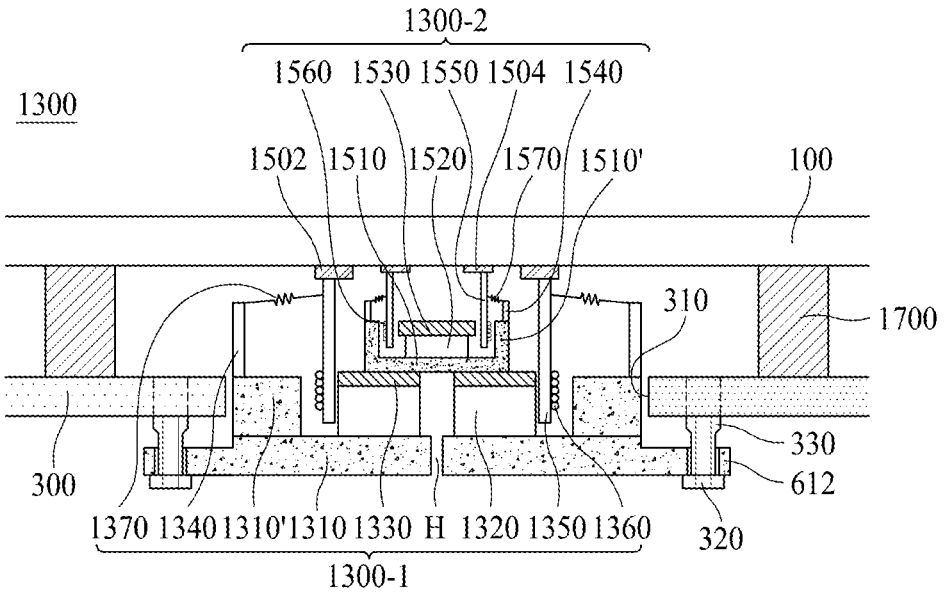
FIG. 11 illustrates a display apparatus according to an embodiment of the present disclosure.

FIG. 11 illustrates a display apparatus according to an embodiment of the present disclosure.

With reference to FIG. 11, a sound generation device 1300, including a first sound generator 1300-1 and a second sound generator 1300-2, may be on a rear surface of a display panel 100. The first sound generator 1300-1 may be a magnetic circuit, and the second sound generator 1300-2 may be a magnetic circuit. In FIG. 11, the first sound generator 1300-1 is illustrated as having the second structure of the FIG. 2B example, but the first structure of the FIG. 2A example may also be applied. Description given above with reference to the examples of FIGS. 5 and 6 may be applied to a connection structure of the first sound generator 1300-1 and a supporting member 300, and duplicate description is omitted.

The first sound generator 1300-1 may include plates 1310 and 1310', a magnet 1220 on the plate 1310, a center pole 1330 on the plate 1310, a bobbin 1350 near the center pole 1330, and a coil 1360 around the bobbin 1350. The coil 1360 may be wound around the bobbin 1350. A diameter of the bobbin 1350 may be set to be large, and for example, may be about 40π to 50π units, e.g., millimeters (mm). However, embodiments are not limited thereto.

A frame 1340 may be on the second plate 1310', e.g., along a periphery of the first plate 1310. A damper 1370 may be between the frame 1340 and a portion of an upper portion of the bobbin 1350. The damper may be expressed by another term, such as an "edge."

The supporting member 300 may be on a rear surface of the display panel 100. In an extension portion 612, there may be a screw 320 and a nut 330. By using the nut 330 fixed to the supporting member 300, the first sound generator 1300-1 may be connected with the supporting member 300 by the screw 320. For example, the nut 330 may be a self-clinching nut. One example of the self-clinching nut is a PEM® nut, but embodiments are not limited thereto.

The first sound generator 1300-1 may be attached to the supporting member 300 by an adhesive member. The adhesive member may include a double-sided tape, a single-sided tape, an adhesive, a bond, and/or the like, but embodiments are not limited thereto.

The first sound generator 1300-1 may be attached to the rear surface of the display panel 100 by a first adhesive member 1502. The first adhesive member 1502 may include a double-sided tape, a single-sided tape, an adhesive, a bond, and/or the like, but embodiments are not limited thereto. Also, the first adhesive member 1502 may be in a particular portion in which the first sound generator 1300-1 is attached to the display panel 100, but embodiments are not limited thereto. The first adhesive member 1502 may be provided on an entire (or whole) rear surface of the display panel 100. For example, the first adhesive member 1502 may be on an entire (or whole) surface between the display panel 100 and the first sound generator 1300-1.

To decrease a size (for example, a thickness or a height) of the sound generation device 1300, a diameter of the first sound generator 1300-1 may be largely set. A diameter of the first sound generator 1300-1 may be greater than that of the second sound generator 1300-2. Also, the second sound generator 1300-2 may be in or over the first sound generator 1300-1. For example, the second sound generator 1300-2 may be in or over a center of the first sound generator 1300-1. Also, the second sound generator 1300-2 may be in or over a center of the bobbin 1350 of the first sound generator 1300-1. Therefore, to complement a sound having the high-pitched sound band caused by an increase in a diameter of the first sound generator 1300-1, the second sound generator 1300-2 may be in the first sound generator 1300-1. Therefore, a slim structure may be implemented by decreasing a size (for example, a thickness or a height) of a sound generation device, thereby providing a display apparatus for avoiding or preventing sound having the high-pitched sound band from being reduced.

The second sound generator 1300-2 may be a micro tweeter speaker. The second sound generator 1300-2 and the first sound generator 1300-1 may be on a same axis. For example, the second sound generator 1300-2 may be a coaxial sound generator in which a first sound generator for outputting a sound having the low-pitched sound band and a second sound generator for outputting a sound having the high-pitched sound band are on the same axis. Therefore, a sound having the high-pitched sound band and the same phase may be reproduced by using the first sound generator for outputting a sound having the low-pitched sound band and the second sound generator for outputting a sound having the high-pitched sound band. For example, the low-pitched sound band may be about 200 Hz or less, the middle-pitched sound band may be about 200 Hz to 3 kHz, and the high-pitched sound band may be about 3 kHz or more.

The second sound generator 1300-2 may be a magnetic circuit. Also, the second sound generator 1300-2 may include plates 1510 and 1510', a magnet 1520 on the plate 1510, a center pole 1530 on the plate 1510, a bobbin 1550 near the center pole 1330, and a coil 1560 around the bobbin 1550. The coil 1560 may be wound around the bobbin 1550. A diameter of the bobbin 1550 may be less than that of the bobbin 1350 of the first sound generator 1300-1. For example, a diameter of the bobbin 1550 may be about 20π to 30π units, e.g., millimeters (mm). However, embodiments are not limited thereto.

A frame 1540 may be on the second plate 1510' along a periphery of the first plate 1510. A damper 1570 may be between the frame 1540 and some portion of an upper portion of the bobbin 1550. The damper may be expressed by another term, such as an "edge."

The second sound generator 1300-2 may be attached to the rear surface of the display panel 100 by a second adhesive member 1504. The second adhesive member 1504 may include a double-sided tape, a single-sided tape, an adhesive, a bond, and/or the like, but embodiments are not limited thereto. Also, the second adhesive member 1504 may be provided in a particular portion in which the second sound generator 1300-2 may be attached to the display panel 100, but embodiments are not limited thereto. The second adhesive member 1504 may be provided on an entire (or whole) rear surface of the display panel 100. For example, the second adhesive member 1504 may be on an entire (whole) surface between the display panel 100 and the second sound generator 1300-2. Also, the first sound generator 1300-1 and the second sound generator 1300-2 may be attached to the rear surface of the display panel 100 by one adhesive member.

A wiring for applying a signal to the second sound generator 1300-2 may be provided. The wiring may be in a groove or a hole H in the first sound generator 1300-1, but embodiments are not limited thereto. For example, the wiring may be in a groove or a hole in the supporting member 300. Also, the wiring may be in a groove or a hole in the first plate 1510 or the center pole 1530 and the second plate 1510'.

A partition 1700 may be near the rear surface of the display panel 100. For example, the partition 1700 may be between the display panel 100 and the supporting member 300. Also, the partition 1700 may be between the rear surface of the display panel 100 and the supporting member 300.

The partition 1700 may be an air gap or a space in which a sound may be generated when the display panel 100 is vibrated by the sound generation device 1300. An air gap or a space that generates or transfers a sound may be referred to as a "partition." A partition may be referred to as an "enclosure" or a "baffle," but the term is not limited thereto. The partition 1700 may be a whole area of four outer sides of the rear surface of the display panel 100. Also, the partition 1700 may be a sealed structure, or may be an unsealed structure.

The partition 1700 may be formed of polyurethane, polyolefin, polyethylene, and/or the like, but embodiments are not limited thereto. Also, the partition 1700 may include a double-sided tape, a single-sided tape, an adhesive, a bond, and/or the like, and for example, may be formed of a material having an elasticity that may enable compression to be formed to some extent.

Figure 12:
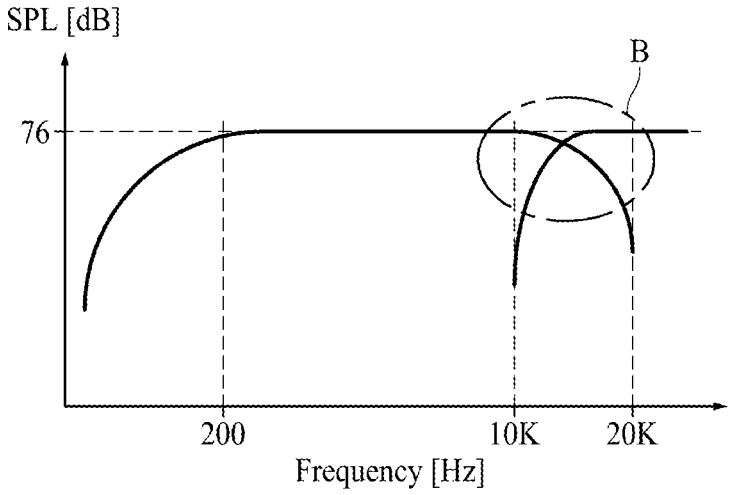
FIG. 12 illustrates a sound output characteristic according to an embodiment of the present disclosure.

FIG. 12 illustrates a sound output characteristic according to an embodiment of the present disclosure.

In FIG. 12, the abscissa axis (x-axis) represents a frequency in hertz (Hz), and the ordinate axis (y-axis) represents a sound pressure level (SPL) in decibels (dB). FIG. 12 shows a result obtained by measuring a sound output characteristic according to the embodiment of each of the examples of FIGS. 10 and 11. A method of measuring a sound output characteristic is substantially similar to the description given above with reference to FIG. 7, and a duplicate description is omitted.

With reference to FIG. 12, it can be seen that a sound having the low sound-pitched band may be generated by a first sound generator. For example, it can be seen that the sound having the low-pitched sound band may be generated at 200 Hz or less. Also, it can be seen that a sound having the high-pitched sound band may be generated by a second sound generator. For example, it can be seen that the sound having the high-pitched sound band may be generated at 3 kHz or more. Also, a portion in which the sound generated by the first sound generator overlaps the sound generated by the second sound generator may be referred to as "crossover." The portion is referred to by the region B, and the crossover may be a portion in which the sound having the low-pitched sound band and the sound having the high-pitched sound band are separated from each other. Also, as shown in FIG. 7, a crossover frequency may show an effect in which a sound has one full-range frequency domain through crossover. Therefore, a display apparatus for generating a uniform sound pressure level in a full frequency domain may be implemented. Also, if one crossover frequency is displayed, a speaker may be a two-way speaker, and when two crossover frequencies are displayed, a speaker may be a three-way speaker. A uniform sound pressure level may be realized in a virtual full-range frequency domain, based on crossover.

FIGS. 13A to 13D illustrate a display apparatus according to an embodiment of the present disclosure.

In the examples of FIGS. 13A to 13D, the sound generation device of the FIG. 10 example is illustrated. However, the sound generation device of the FIG. 11 example may be similarly applied.

Figure 13A:
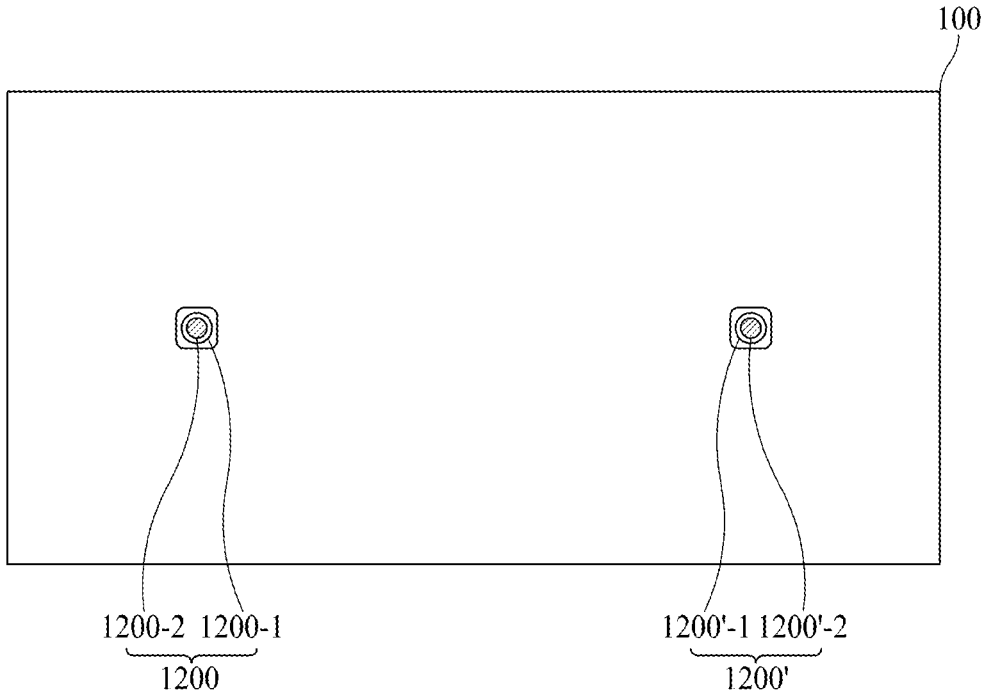
FIGS. 13A to 13D illustrate a display apparatus according to an embodiment of the present disclosure.
Figure 13B:
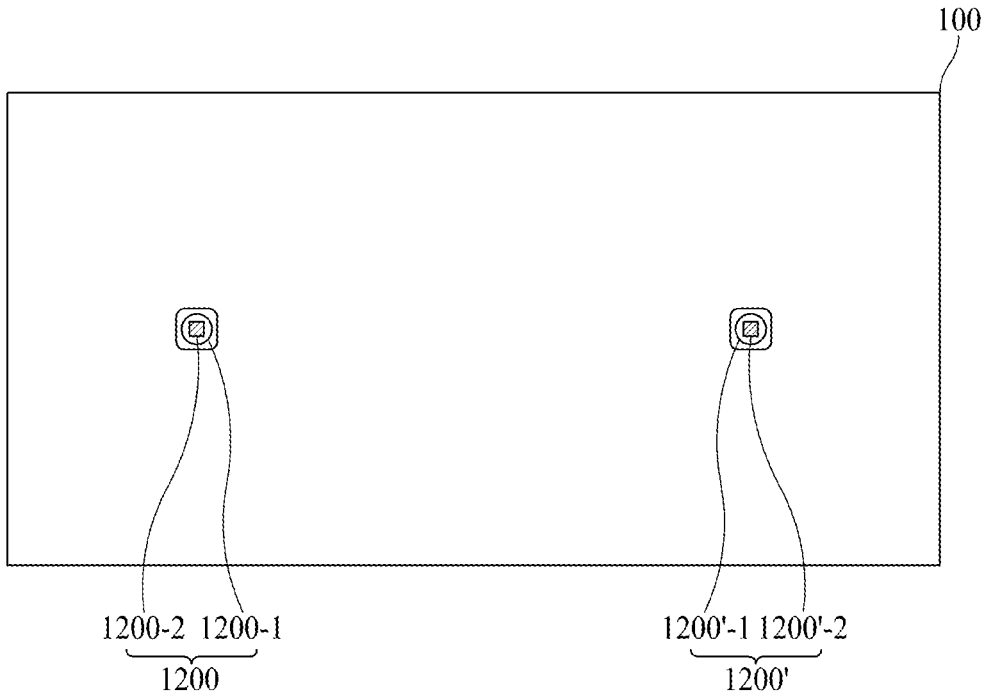

With reference to FIGS. 13A and 13B, two sound generation devices may be on a rear surface of a display panel 100. A first sound generation device 1200 may be in a left region of the rear surface of the display panel 100, and a second sound generation device 1200' may be in a right region of the rear surface of the display panel 100. It should be appreciated that "left" and "right" are interchangeable, as would be understood to one of ordinary skill in the art. The first sound generation device 1200 may include a first sound generator 1200-1 and a second sound generator 1200-2. The second sound generator 1200-2 may be in or over the first sound generator 1200-1. The first sound generator 1200-1 may include a magnetic circuit, and the second sound generator 1200-2 may include a piezoelectric vibrator or a magnetic circuit. The second sound generation device 1200' may include a first sound generator 1200'-1 and a second sound generator 1200'-2. The second sound generator 1200'-2 may be in or over the first sound generator 1200'-1. The first sound generator 1200'-1 may include a magnetic circuit, and the second sound generator 1200'-2 may include a piezoelectric vibrator or a magnetic circuit.

With reference to the FIG. 13A example, a shape of each of the first sound generator 1200-1 and the second sound generator 1200-2 of the first sound generation device 1200 may be implemented as a circular shape, or may be implemented as an oval shape or a track shape, without being limited thereto. An oval shape may include an elliptical shape, an egg-shape, a rectangular shape with rounded corners, or other non-circular curved shape having a width different from its height. For example, when each of the first sound generator 1200-1 and the second sound generator 1200-2 of the first sound generation device 1200 is includes a magnetic circuit, a shape of a bobbin in each of the first sound generator 1200-1 and the second sound generator 1200-2 may be one of a circular shape, an oval shape, and track shape. Also, a shape of each of the first sound generator 1200'-1 and the second sound generator 1200'-2 of the first sound generation device 1200' may be implemented as a circular shape, or may be implemented as an oval shape or a track shape, without being limited thereto. For example, when each of the first sound generator 1200'-1 and the second sound generator 1200'-2 of the first sound generation device 1200' includes a magnetic circuit, a shape of a bobbin included in each of the first sound generator 1200'-1 and the second sound generator 1200'-2 may be one of a circular shape, an oval shape, and a track shape. When a shape of a sound generator is implemented as an oval shape or a track shape, directivity may be improved. Directivity may represent a frequency response characteristic with respect to a predetermined angular direction (for example, a 30-degree direction, a 60-degree direction, and a 90-degree direction) from a front surface of a speaker. Therefore, when a shape of a sound generator is implemented as an oval shape or a track shape, a sound characteristic may be enhanced.

When the first sound generator 1200-1 of the first sound generation device 1200 includes a magnetic circuit and the second sound generator 1200-2 includes a piezoelectric vibrator, a shape of a bobbin in the first sound generator 1200-1 may be one of a circular shape, an oval shape, and track shape; and a shape of the second sound generator 1200-2 may be one of a circular shape, an oval shape, a track shape, and a tetragonal (rectangular or square) shape. Also, when the first sound generator 1200'-1 of the second sound generation device 1200' includes a magnetic circuit and the second sound generator 1200'-2 includes a piezoelectric vibrator, a shape of a bobbin in the first sound generator 1200'-1 may be one or more of a circular shape, an oval shape, and track shape; and a shape of the second sound generator 1200'-2 may be one or more of a circular shape, an oval shape, a track shape, and a tetragonal (e.g., rectangular or square) shape.

With reference to the FIG. 13B example, a shape of each of the second sound generator 1200-2 of the first sound generation device 1200 and the second sound generator 1200'-2 of the second sound generation device 1200' may be a tetragonal (e.g., rectangular or square) shape. For example, when the first sound generator 1200-1 of the first sound generation device 1200 includes a magnetic circuit and the second sound generator 1200-2 includes a piezoelectric vibrator, a shape of the second sound generator 1200-2 may be a tetragonal (e.g., rectangular or square) shape. Also, when the first sound generator 1200'-1 of the second sound generation device 1200' includes a magnetic circuit and the second sound generator 1200'-2 includes a piezoelectric vibrator, a shape of the second sound generator 1200'-2 may be a tetragonal (rectangular or square) shape. When a shape of each of the second sound generators 1200-2 and 1200'-2 is a tetragonal (rectangular or square) shape, directivity may be improved.

The first sound generator 1200-1 and the second sound generator 1200-2 of the first sound generation device 1200 may each be one or more of: a circular shape, an oval shape, and a track shape. The first sound generator 1200'-1 of the second sound generation device 1200' may be one of: a circular shape, an oval shape, and a track shape. The second sound generator 1200'-2 of the second sound generation device 1200' may be one of a circular shape, an oval shape, a track shape, and a tetragonal (e.g., rectangular or square) shape.

The first sound generator 1200-1 of the first sound generation device 1200 may each be one of: a circular shape, an oval shape, and a track shape. The second sound generator 1200-2 of the first sound generation device 1200 may be one of: a circular shape, an oval shape, a track shape, and a tetragonal (e.g., rectangular or square) shape. The first sound generator 1200'-1 and the second sound generator 1200'-2 of the second sound generation device 1200' may each be one or more of: a circular shape, an oval shape, and a track shape.

Figure 13C:
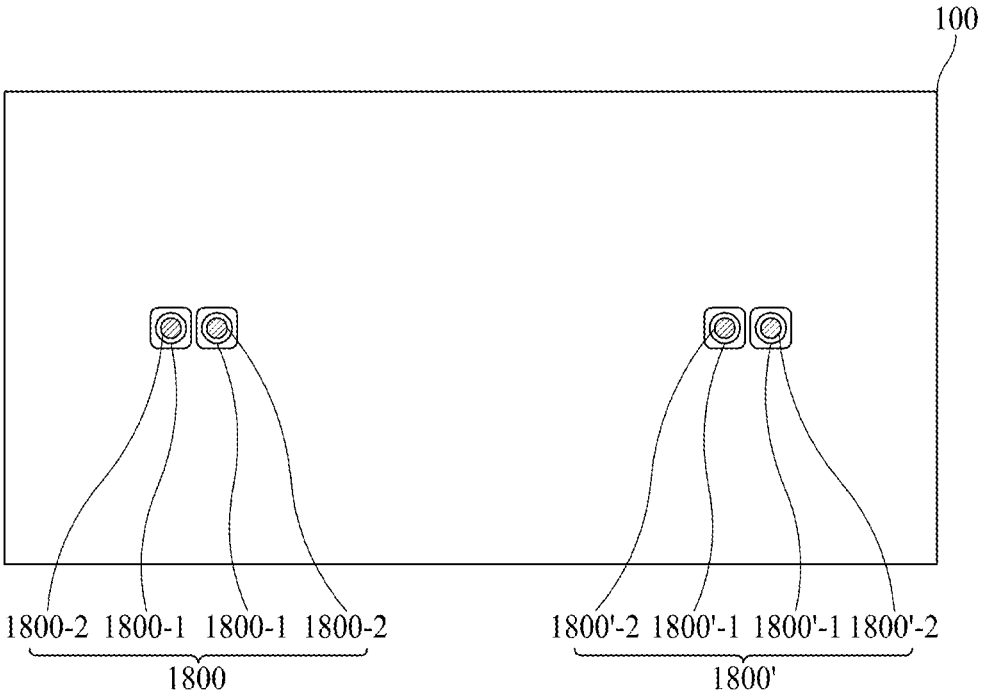
Figure 13D:
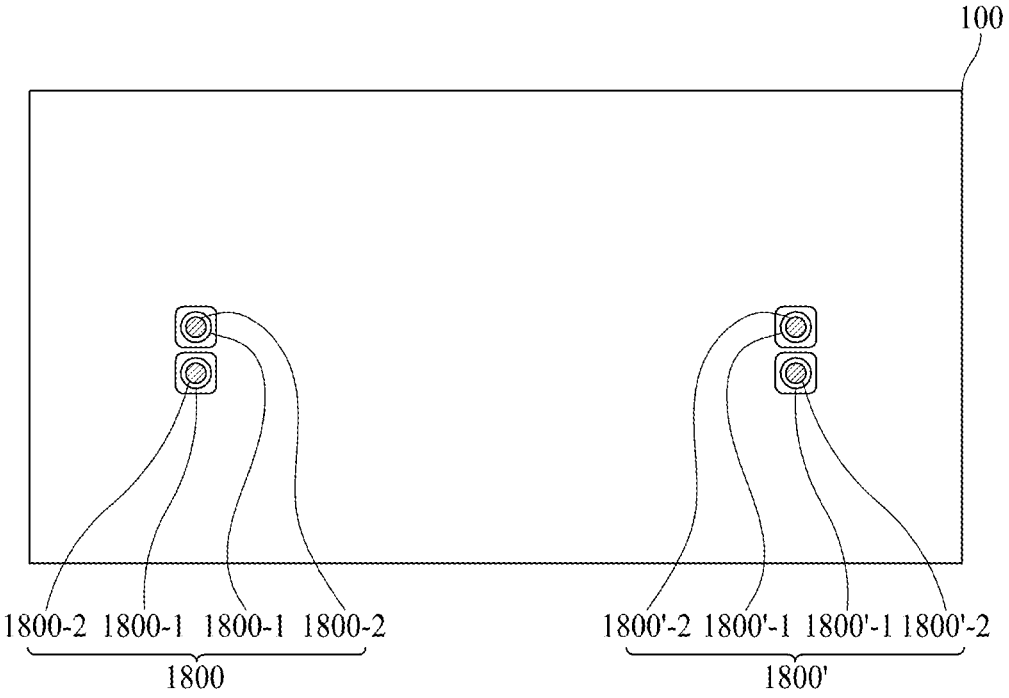

With reference to FIGS. 13C and 13D, a pair of sound generation devices may be on a rear surface of a display panel 100. When the display panel 100 includes a pair of sound generation devices, a sound having the low-pitched sound band may be enhanced. A first sound generation device 1800 may be in a left region of the rear surface of the display panel 100, and a second sound generation device 1800' may be in a right region of the rear surface of the display panel 100. A pair of sound generation devices 1800 may each include a first sound generator 1800-1 and a second sound generator 1800-2. The second sound generator 1800-2 may be in the first sound generator 1800-1. The second sound generation device 1800' may include a first sound generator 1800'-1 and a second sound generator 1800'-2. The second sound generator 1800'-2 may be in the first sound generator 1800'-1.

With reference to FIG. 13C, the first and second sound generation devices 1800 and 1800', respectively in the left region and the right region of the rear surface of the display panel 100, may be in parallel with a first side of the display panel 100. The display panel 100 may include the first side and a second side vertical to the first side. The first side may be a widthwise (or horizontal) direction of the display panel 100, and the second side may be a lengthwise (or vertical) direction of the display panel 100. As used herein, the terms "widthwise direction" and "horizontal direction" refer to a direction of a long side of a display apparatus, and may be used interchangeably. As used herein, the terms "lengthwise direction" and "vertical direction" refer to a direction perpendicular to the widthwise (or horizontal) direction, and may be used interchangeably. In addition, the widthwise (or horizontal) direction may be referred to as a "landscape" direction of the display panel, and the lengthwise (or vertical) direction may be referred to as a "portrait" direction of the display panel. With reference to FIG. 13D, the first and second sound generation devices 1800 and 1800' respectively in the left region and the right region of the rear surface of the display panel 100 may be parallel to the second side of the display panel 100. Based on such configuration, a directivity attenuation effect of a horizontal portion may be reduced or prevented. The sound generation device of FIG. 13B may be similarly applied to the embodiments of FIGS. 13C and 13D.

Figure 14A:
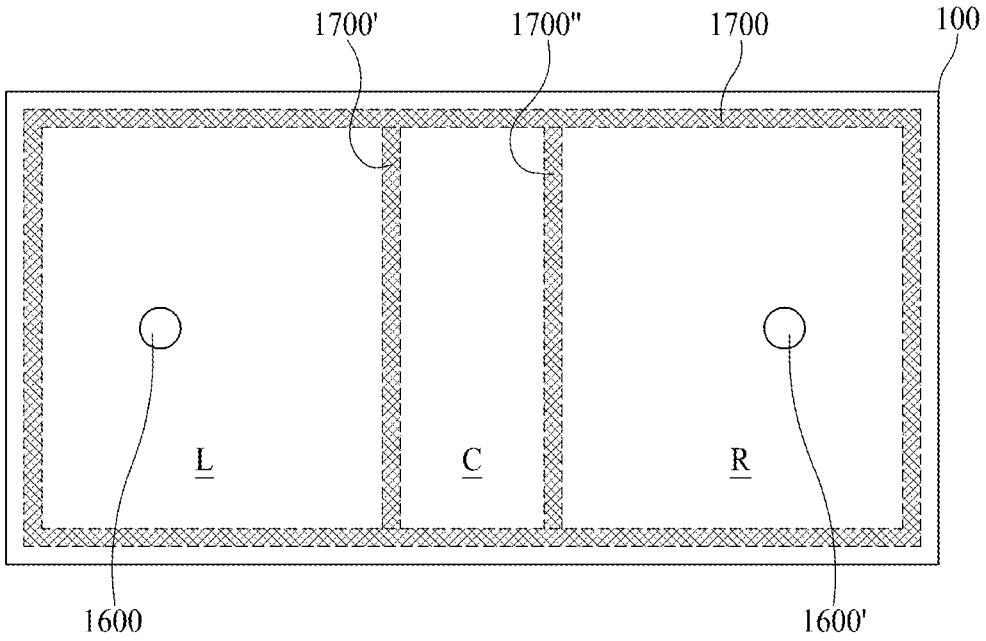
FIGS. 14A to 14C illustrate examples of a sound generation device and a partition in a display apparatus according to an embodiment of the present disclosure.
Figure 14B:
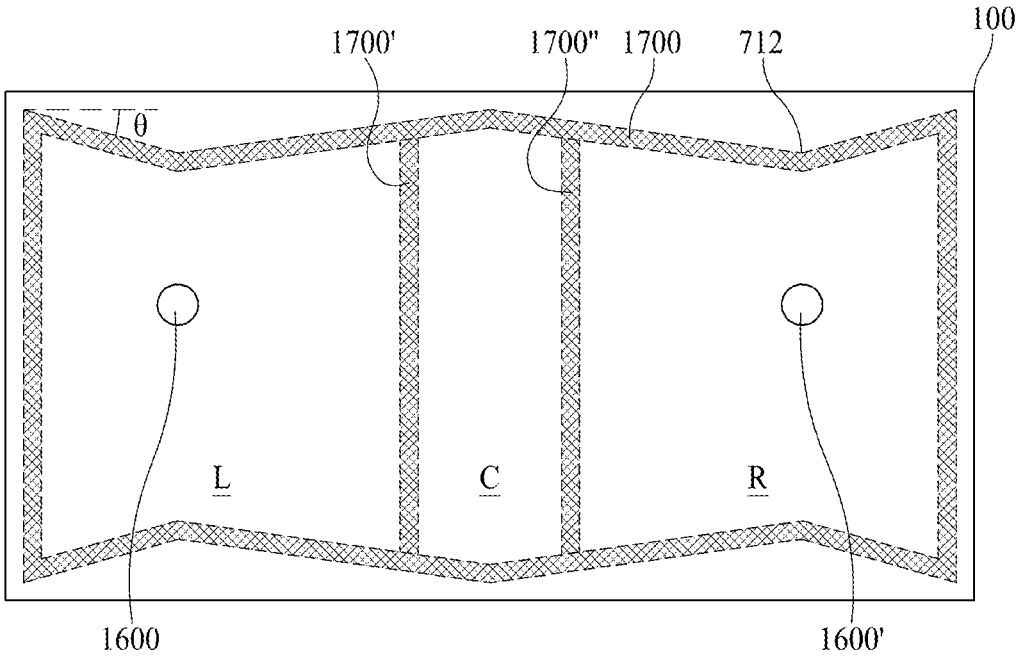
Figure 14C:
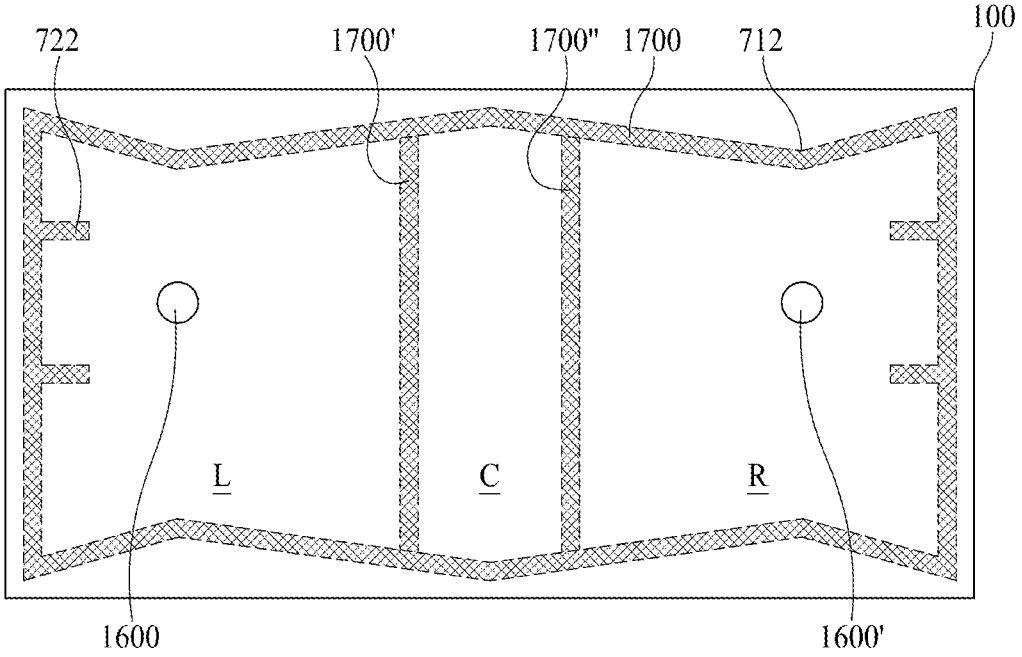

FIGS. 14A to 14C illustrate examples of a sound generation device and a partition in a display apparatus according to an embodiment of the present disclosure.

As illustrated in the examples of FIGS. 14A to 14C, a partition having a double structure or a dual-structure including two or more partitions may be provided. For example, the left region and the right region of the display panel 100 may have the same vibration characteristic when realizing a mono sound in which the left and right regions output the same sound. As such, a resonance phenomenon or an interference phenomenon may be maximized in a certain frequency band, causing a reduction in sound pressure level. Therefore, the partition may be configured in a structure including two or more partitions, e.g., for decreasing an influence of a sound characteristic caused by a resonance frequency difference of a middle-high-pitched sound that may occur in a first sound generation device 1600 in a first region L (the left region) and a second sound generation device 1600' in a second region R (the right region). In FIGS. 14A to 14C, the partition having the double structure is illustrated, but embodiments may include three or more partitions without being limited thereto. When three or more partitions are provided, a sound pressure level may be avoided or prevented from being reduced, even when sound interference in the left and right regions increases, thereby reducing or preventing a sound output characteristic from being discontinuously recognized.

The first sound generation device and the second sound generation device may output different sounds having a middle-high-pitched sound band, and a stereo sound may be output by separating a left sound and a right sound, Also, the first sound generation device may be in the first region L, which may be the left region, the second sound generation device may be in the second region R, which may be the right region, and a sound generation device may not be provided in a third region, which may be a center region. Therefore, the degradation in sound quality caused by interference may be reduced in the left region and the right region. Also, a sound characteristic corresponding to the middle-high-pitched sound band may be further enhanced.

With reference to the FIG. 14A example, a first sound generation device 1600 may be in a first region L, which may be a left region of a rear surface of a display panel 100, and a second sound generation device 1600' may be in a second region R, which may be a right region of the rear surface of a display panel 100. Also, at least two partitions, for example, a first partition 1700' and a second partition 1700", may be between the first sound generation device 1600 and the second sound generation device 1600'. Also, the first partition 1700' may be provided as two or more sub-partitions between the first sound generation device 1600 and the second sound generation device 1600'.

A third partition 1700 may surround the first region L, the second region R, and a third region C. The third partition 1700 may be in a periphery of the rear surface of the display panel 100. The third partition 1700 may be in a periphery of a supporting member or a periphery of a front surface of the supporting member. Also, the third partition 1700 may be between the display panel 100 and the supporting member, and the third partition 1700 may be between the rear surface of the display panel 100 and the front surface of the supporting member.

The first partition 1700', the second partition 1700", and the third partition 1700 may be on the rear surface of the display panel 100. The first partition 1700' and the second partition 1700" may be on a rear surface or the front surface of the supporting member. Also, the first partition 1700', the second partition 1700", and the third partition 1700 may be between the display panel 100 and the supporting member 300.

Therefore, two or more partitions may be in a center region of the display panel 100, thereby decreasing an influence of a sound characteristic caused by a resonance frequency difference of a middle-high-pitched sound in the left region and the right region of the display panel 100.

A sound wave, generated when a display panel vibrates by a sound generation device may progress (or spread) radially from a center of the sound generation device, and may travel. The sound wave may be referred to as a "progressive wave." The progressive wave may be reflected by one side of the partition to generate a reflected wave, and the reflected wave may travel in an opposite direction of the progressive wave. The reflected wave may overlap or interfere with the progressive wave and may not travel, thereby generating a standing wave that stands at a certain position. A sound pressure may be reduced by the standing wave, thus, a sound output characteristic may be reduced. Therefore, a bent portion may be provided in the partition to decrease the phenomenon of reduction in sound pressure level caused by the standing wave generated by interference between the reflected wave and the progressive wave. Also, the standing wave which causes the sound pressure level to be reduced, may be generated more at a position at which a level of the progressive wave and the reflected wave is large. Accordingly, the bent portion may be disposed at a position at which a level of a sound wave transferred from the vibration generation device is highest. This will be described in detail below with reference to the examples of FIGS. 14B and 14C.

In FIGS. 14B and 14C, a partition having a double structure including two or more partitions may be provided, and a bent portion may be further provided on at least one side of the partition. With reference to FIGS. 14B and 14C, a first sound generation device 1600 may be in a first region L, which may be a left region of a rear surface of a display panel 100, and a second sound generation device 1600' may be in a second region R, which may be a right region of the rear surface of a display panel 100. Also, at least two partitions, for example, a first partition 1700' and a second partition 1700" may be between the first sound generation device 1600 and the second sound generation device 1600'. Alternatively, the first partition 1700' may be provided as two or more sub-partitions between the first sound generation device 1600 and the second sound generation device 1600'.

A third partition 1700 may surround the first region L, the second region R, and a third region C. The third partition 1700 may be in a periphery of the rear surface of the display panel 100. Also, a bent portion 712 may be further provided on at least one side of the third partition 1700.

The bent portion 712 may be on one or more sides, e.g., where a strongest sound wave reaches, among four sides of the third partition 1700. The bent portion 712 may be configured to face (or extend) toward the first and second sound generation devices 1600 and 1600'. For example, the bent portion 712 may face a center of each of the first and second sound generation devices 1600 and 1600'. Accordingly, the phenomenon of reduction in a sound pressure level caused by a standing wave may be reduced.

The rear surface of the display panel 100 may include four sides, and the bent portion 712 may be provided on each of one or more first sides of the four sides. Therefore, each of two sides, for example, an upper side and a lower side, among four sides surrounding the display panel 100 may be a bent portion 712 to have a particular inclined angle (θ) with respect to a horizontal direction (or a widthwise direction) of the display panel 100. The bent portion 712 may be configured with two straight-line portions and may be formed at a position where the two straight-line portions meet. Also, the bent portion 712 may have a rectilinear shape, a curve shape, a round shape, or the like, but the structures are not limited to these shapes.

The inclined angle (θ) of the bent portion 712 may be set for restriction of the standing wave, and the inclined angle (θ) of the bent portion may be adjusted with a range, e.g., from 10° to 30°. For example, if a sound output range for the low-pitched sound band or a large output of the sound generation device, the inclined angle (θ) of the bent portion 712 becomes large. In a case of a sound output range for a high-pitched sound band or a small output of the sound generation device, an inclined angle (θ) of the bent portion 712 may become small. For example, the inclined angle (θ) of the bent portion 712 may be the angle obtained by one side of the third partition 1700 and the horizontal direction (or a widthwise direction) of the display panel 100. Herein, the horizontal direction (or the widthwise direction) corresponds to the direction of a long side of the display apparatus, and the vertical direction (or the lengthwise direction) corresponds to the direction of the short side of the display apparatus.

The third partition 1700 may be in a periphery of a supporting member or a periphery of a front surface of the supporting member. Also, the third partition 1700 may be between the display panel 100 and the supporting member, and the third partition 1700 may be between the rear surface of the display panel 100 and the front surface of the supporting member.

The first partition 1700', the second partition 1700", and the third partition 1700 may be on the rear surface of the display panel 100. The first partition 1700' and the second partition 1700" may be on a rear surface or a front surface of the supporting member 300. Also, the first partition 1700', the second partition 1700", and the third partition 1700 may be between the display panel 100 and the supporting member 300.

The third partition 1700 may be provided in a bent shape between the first partition 1700' and the second partition 1700", or may be provided in an unbent shape. The bent shape of the third partition 1700 may face the display panel 100. Also, the third partition 1700 may be provided in a bent shape, a rectilinear shape, a straight-line shape, a curve shape, or a round shape between the first partition 1700' and the second partition 1700". However, the shape of the third partition 1700 is not limited to these examples.

The third partition 1700 may be provided in a zigzag shape or a bow necktie shape. When the third partition 1700 has a zigzag shape or a bow necktie shape, the third partition 1700 may be provided in a zigzag shape or a bow necktie shape between the first partition 1700' and the second partition 1700", or may not have a zigzag shape or a bow necktie shape.

With reference to the FIG. 14C example, the bent portion 712 and a protrusion portion 722 may be provided. For example, the bent portion 712 may be on one or more sides of the third partition 1700, and one or more protrusion portion 722 may be on a side perpendicular to a side on which the bent portion 712 is provided. A protrusion portion 722 in the left region L of the display panel 100 may face or extend toward the first sound generation device 1600. Also, a protrusion portion 722 in the right region R of the display panel 100 may face or extend toward the second sound generation device 1600'.

The protrusion portion 722 may trap the reflected wave, thereby decreasing the reduction of sound pressure level by the standing wave. At least one protrusion portion 722 may be formed in at least one side of the third partition 1700, and the at least one protrusion portion 722 may be symmetrically disposed with respect to the sound generation device. In FIG. 14C, at least one protrusion portion 722 may be formed any one side of the first side and the second side being perpendicular to the first side among four sides of the display panel 100.

In FIGS. 14A to 14C, the third partition 1700 may be a sealed structure, or may be an unsealed structure. If the third partition 1700 has the unsealed structure, the cost for the third partition 1700 may be reduced in comparison to the case of the sealed structure. There may be no difference in sound characteristics between the third partition 1700 having the unsealed structure and the third partition 1700 having the sealed structure.

In the examples of FIGS. 14A to 14C, the display panel 100 may include three regions, and a sound generation device may not be in the third region C, which may be a center region of the display panel 100. Also, area size of the third region C may be relatively smaller than each of area size of the first region L and an area of the second region R. Accordingly, a sound having the low-pitched sound band may be enhanced. Also, the third region C may decrease the degradation in sound quality caused by interference in the first region L and the second region R. Accordingly, a sound having each of the low, middle, and high-pitched sound bands may be enhanced.

FIGS. 14A to 14C illustrate examples in which the sound generation device is in the left region or the right region, but is not in a center of the left region (the first region L) or the right region (the second region R) of the display panel 100. However, embodiments are not limited thereto. For example, the sound generation device may be in the center of the left region (the first region L) or the right region (the second region R) of the display panel 100. Alternatively, the sound generation device may be asymmetrically disposed in the left region (the first region L) and the right region (the second region R) of the display panel 100. A stereo sound characteristic may be further enhanced when the sound generation device is in the left region or the right region, as opposed to when the sound generation device is in the center of the left region (the first region L) or the right region (the second region R) of the display panel 100.

In FIGS. 14A to 14C, a circular sound generation device has been described as an example. Descriptions given above with reference to FIGS. 14A to 14C may be similarly applied to an oval sound generation device.

A sound output characteristic corresponding to a case where a bent portion is provided will be described below with reference to the example of FIG. 15. Also, a sound output characteristic corresponding to a case in which a bent part and a protrusion portion are provided will be described below with reference to the example of FIG. 16.

Figure 15:
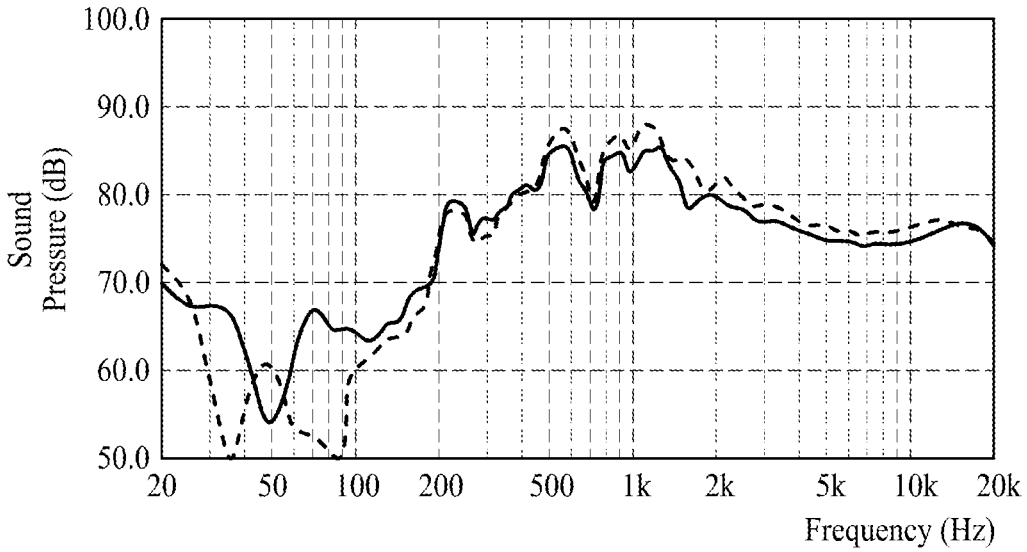
FIG. 15 illustrates a sound output characteristic according to an embodiment of a sound generation device and a partition in a display apparatus according to an embodiment of the present disclosure.

FIG. 15 illustrates a sound output characteristic according to an embodiment of a sound generation device and a partition in a display apparatus according to an embodiment of the present disclosure.

In the FIG. 15 example, a dotted line indicates the sound output characteristic according to the example of FIG. 14A, and a solid line indicates the sound output characteristic according to the example of FIG. 14B. With reference to FIG. 15, in comparison to the case without the bent portion, the case with the bent portion has improved sound output characteristics in the low-pitched sound band of about 200 Hz or less.

Figure 16:
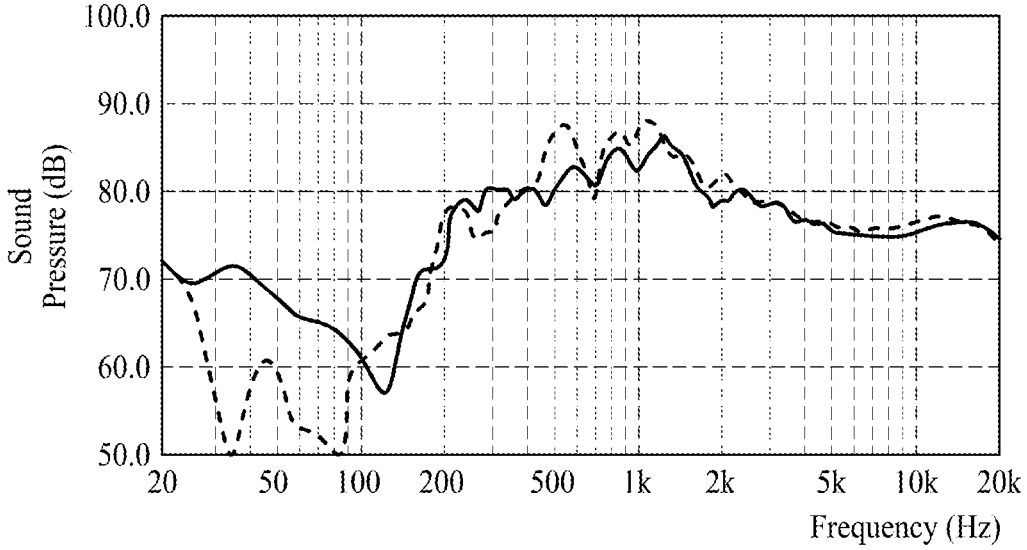
FIG. 16 illustrates a sound output characteristic according to an embodiment of a sound generation device and a partition in a display apparatus according to an embodiment of the present disclosure.

FIG. 16 illustrates a sound output characteristic according to an embodiment of a sound generation device and a partition in a display apparatus according to an embodiment of the present disclosure.

In the FIG. 16 example, a dotted line indicates the sound output characteristic according to the example of FIG. 14A, and a solid line indicates the sound output characteristic according to the example of FIG. 14C. With reference to FIG. 16, in comparison to the case without the bent portion and the protrusion portion, the case with the bent portion and the protrusion portion has improved frequency characteristics in the entire sound band.

A method of measuring sound output characteristic in the examples of FIGS. 15 and 16 is similar to the above description with reference to the FIG. 7 example. Duplicate description is omitted.

Figure 17A:
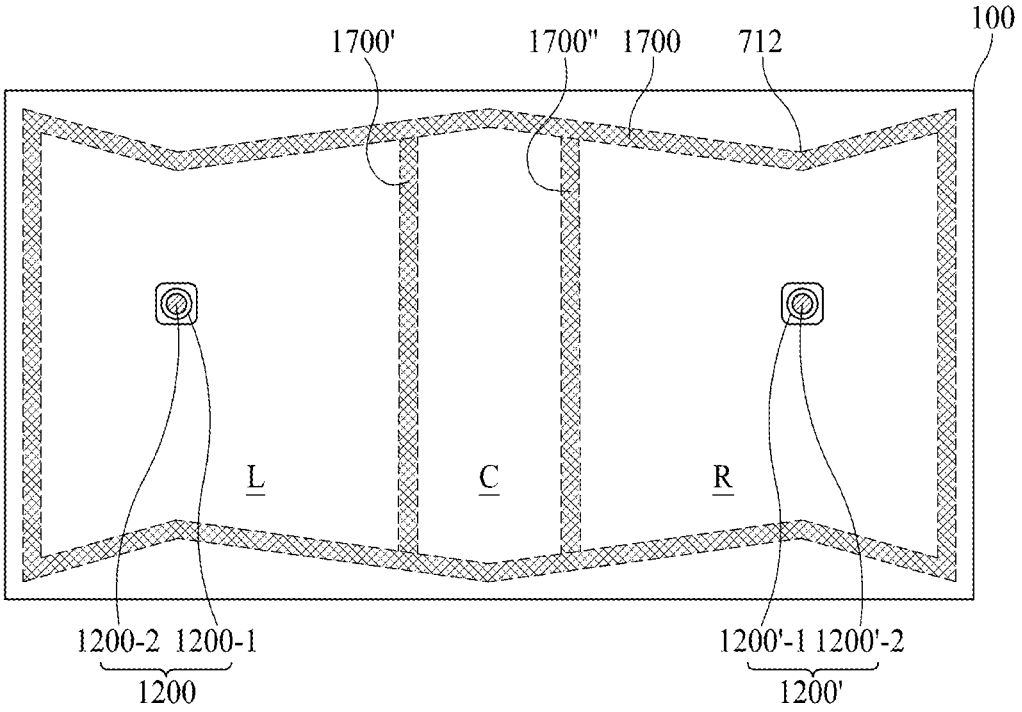
FIGS. 17A to 17C illustrate examples of a sound generation device and a partition, in a display apparatus according to an embodiment of the present disclosure.
Figure 17B:
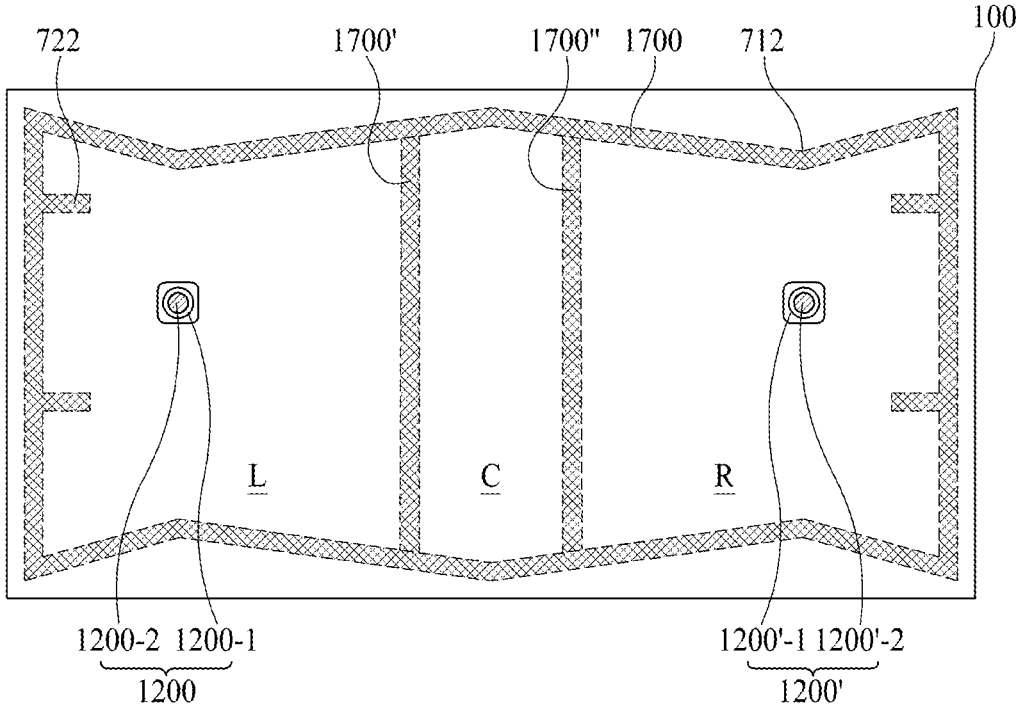
Figure 17C:
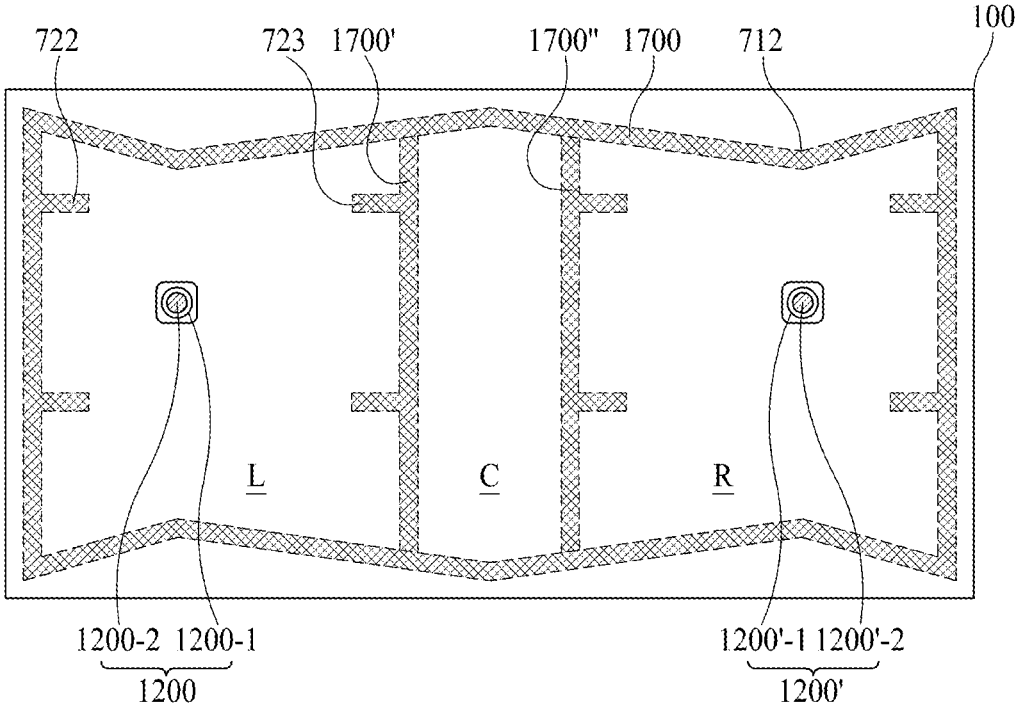

FIGS. 17A to 17C illustrate examples of a sound generation device and a partition in a display apparatus according to an embodiment of the present disclosure.

With reference to the examples of FIGS. 17A to 17C, a rear surface of a display panel 100 may include a first region L, a second region R, and a third region C. The first region L may be a left region of the rear surface of the display panel 100, the second region R may be a right region of the rear surface of the display panel 100, and the third region C may be a center region of the rear surface of the display panel 100. A first sound generation device 1200 may be in the first region L of the rear surface of the display panel 100, and a second sound generation device 1200' may be in the second region R of the rear surface of the display panel 100. Also, the first sound generation device 1200 may include a first sound generator 1200-1 and a second sound generator 1200-2 disposed in the first sound generator 1200-1. The second sound generation device 1200' may include a first sound generator 1200'-1 and a second sound generator 1200'-2 in the first sound generator 1200'-1. The first sound generator 1200-1 of the first sound generation device 1200 and the first sound generator 1200'-1 of the second sound generation device 1200' may each include a magnetic circuit. Also, the second sound generator 1200-2 of the first sound generation device 1200 and the second sound generator 1200'-2 of the second sound generation device 1200' may each include a magnetic circuit or a piezoelectric vibrator. Description relevant thereto is substantially similar to those of the FIGS. 10 and 11 examples, and a duplicate description for the sound generation device will be omitted. Also, descriptions given above with reference to FIGS. 17A to 17C may be similarly applied to the FIG. 13B example.

At least two partitions, for example, a first partition 1700' and a second partition 1700" may be between the first sound generation device 1200 and the second sound generation device 1200'. For example, the first partition 1700' may be between the first region L (the left region of the display panel 100) and the third region C (the center region), and the second partition 1700" may be between the second region R (the right region of the display panel 100) and the third region C (the center region).

The third partition 1700 may be near the display panel 100. For example, the third partition 1700 may be on the rear surface of the display panel 100. Also, the third partition 1700 may be on a rear surface or a front surface of a supporting member. The third partition 1700 may be between the display panel 100 and the supporting member. The third partition 1700 may be an entire (or whole) area of four outer sides of the rear surface of the display panel 100. Also, the third partition 1700 may be a sealed structure, or may be an unsealed structure.

Each of the first partition 1700', the second partition 1700", and the third partition 1700 may be an air gap or a space in which a sound may be generated when the display panel 100 is vibrated by the sound generation devices 1200 and 1200'. An air gap or a space that generates or transfers a sound may be referred to as a "partition." A partition may be referred to as an "enclosure" or a "baffle," but the term is not limited thereto. Also, each of the first partition 1700', the second partition 1700", and the third partition 1700 may be formed of polyurethane, polyolefin, polyethylene, and/or the like, but embodiments are not limited thereto. Also, each of the first partition 1700', the second partition 1700", and the third partition 1700 may include a double-sided tape, a single-sided tape, an adhesive, a bond, and/or the like, and for example, may be formed of a material having an elasticity that may enable compression to be formed to some extent.

A bent portion 712 may be further provided on at least one side of the third partition 1700. The bent portion 712 may be on at least one side, which a strongest sound wave may reach, among four sides of the third partition 1700, and may face the first and second sound generation devices 1200 and 1200'. For example, the bent portion 712 may face a center of each of the first and second sound generation devices 1200 and 1200'. Accordingly, the phenomenon of reduction in a sound pressure level caused by a standing wave may be reduced.

The rear surface of the display panel 100 may include four sides, and the bent portion 712 may be on each of one or more first sides among the four sides. Therefore, each of two sides, for example, an upper side and a lower side among four sides surrounding the display panel 100 may configure a bent portion 712 to have a predetermined inclined angle with respect to a horizontal direction (or a widthwise direction) of the display panel 100. The bent portion 712 may be configured with two straight-line portions, and may be provided at a position at which the two straight-line portions meet. Also, the bent portion 712 may have a rectilinear shape, a straight-line shape, a curve shape, a round shape, or the like, but the shape of the bent portion 712 is not limited to these examples.

The third partition 1700 may be provided in a bent shape between the first partition 1700' and the second partition 1700". Also, the third partition 1700 may have a bent shape, a rectilinear shape, a straight-line shape, a curve shape, or a round shape between the first partition 1700' and the second partition 1700", but the shape of the third partition 1700 is not limited to these examples. Also, the bent shape may face the display panel 100, and a structure between the first partition 1700' and the second partition 1700" may be a sealed structure or an unsealed structure.

With reference to the example of FIG. 17B, the bent portion 712 and a protrusion portion 722 may be provided. For example, the bent portion 712 may be on one or more sides of the third partition 1700, and one or more protrusion portion 722 may be on a side perpendicular to a side on which the bent portion 712 is provided. A protrusion portion 722 in the first region L (e.g., the left region of the display panel 100) may face or extend toward the first sound generation device 1200. Also, a protrusion portion 722 in the second region R (e.g., the right region of the display panel 100) may face or extend toward the second sound generation device 1200'.

The protrusion portion 722 may trap the reflected waves of the first sound generation devices 1200 and 1200', thereby decreasing the phenomenon of reduction in a sound pressure level caused by the standing wave. Also, the protrusion portion 722 may be provided as one or as a plurality on one or more sides of the third partition 1700, and the one or more protrusion portion 722 may be symmetrically disposed with respect to the sound generation device. In the FIG. 17B example, one or more protrusion portion 722 may be on one or more second sides perpendicular to a first side of four sides of the display panel 100. The third partition 1700 may be a sealed structure or an unsealed structure.

With reference to the FIG. 17C example, a protrusion portion 722 may be on one side of the third partition 1700 in each of the left region L and the right region R of the display panel 100. Also, a second protrusion portion 723 may be on one side of each of the first partition 1700' and the second partition 1700". For example, the protrusion portion 722 and the second protrusion 723 may be on at least one side of the third partition 1700 in each of the left region L and the right region R of the display panel 100 to face or extend toward the first and second sound generation devices 1200 and 1200'. The protrusion portion 722 and the second protrusion portion 723 may trap the reflected waves of the first sound generation devices 1200 and 1200', thereby further decreasing the phenomenon of reduction in a sound pressure level caused by the standing wave.

Figure 18A:
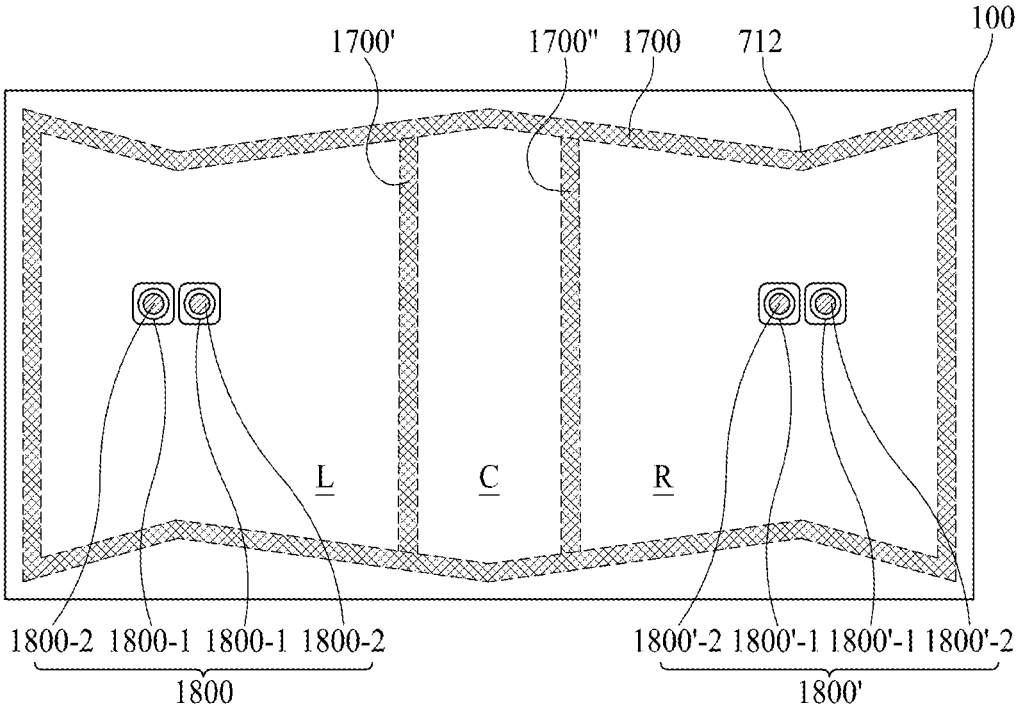
FIGS. 18A to 18C illustrate examples of a sound generation device and a partition, in a display apparatus according to an embodiment of the present disclosure.
Figure 18B:
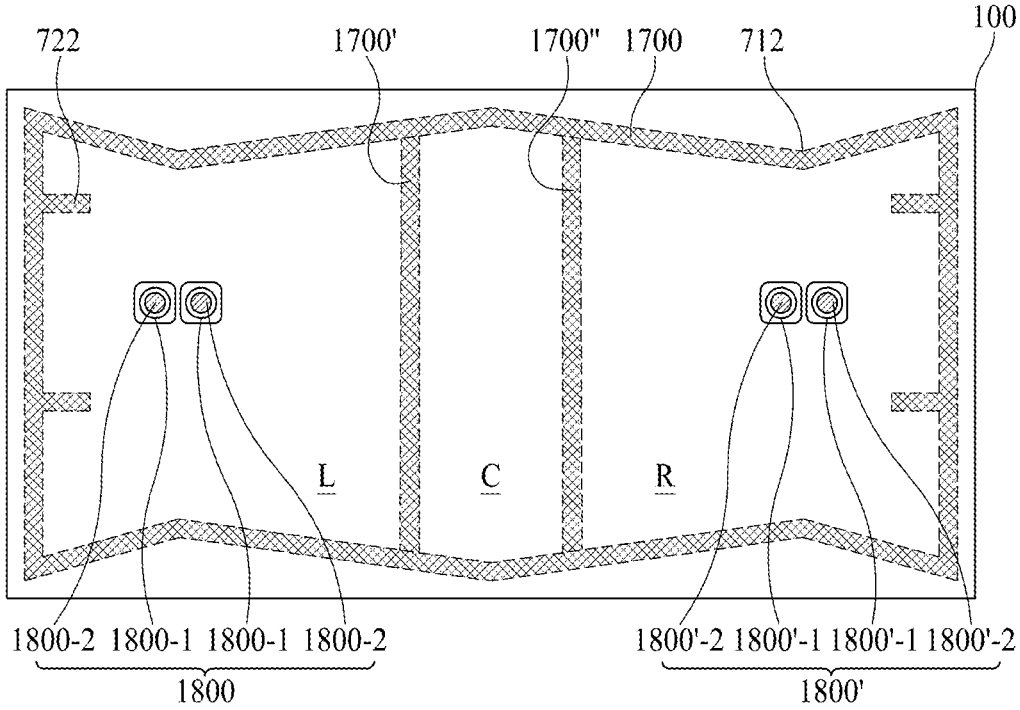
Figure 18C:
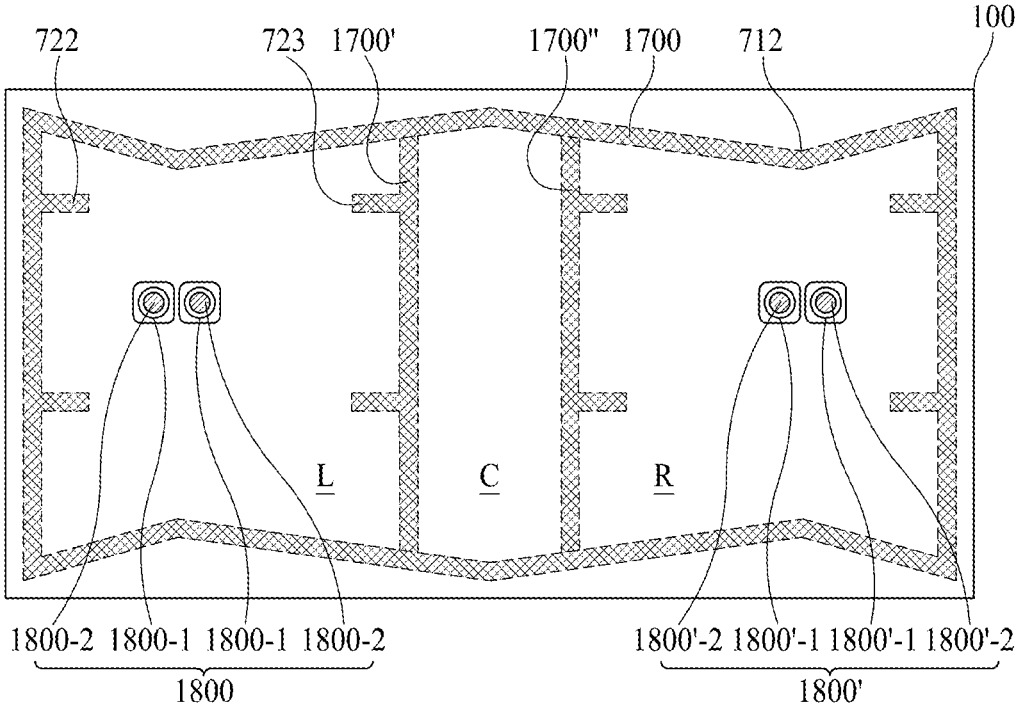

FIGS. 18A to 18C illustrate examples of a sound generation device and a partition in a display apparatus according to an embodiment of the present disclosure.

With reference to the examples of FIGS. 18A to 18C, a rear surface of a display panel 100 may include a first region L, a second region R, and a third region C. The first region L may be a left region of the rear surface of the display panel 100, the second region R may be a right region of the rear surface of the display panel 100, and the third region C may be a center region of the rear surface of the display panel 100. A pair of first sound generation devices 1800 may be in the first region L of the rear surface of the display panel 100, and a pair of second sound generation devices 1800' may be in the second region R of the rear surface of the display panel 100. Also, the pair of first sound generation devices 1800 may each include a first sound generator 1800-1, and a second sound generator 1800-2 in or over the first sound generator 1800-1. The pair of second sound generation devices 1800' may each include a first sound generator 1800'-1, and a second sound generator 1800'-2 in or over the first sound generator 1800'-1. The first sound generator 1800-1 of each of the pair of first sound generation devices 1800 and the first sound generator 1800'-1 of each of the pair of second sound generation devices 1200' may each be configured with a magnetic circuit. Also, the second sound generator 1800-2 of each of the pair of first sound generation devices 1800 and the second sound generator 1800'-2 of each of the pair of second sound generation devices 1800' may each be configured with a magnetic circuit or a piezoelectric vibrator. Descriptions of the pair of first sound generation devices 1800 and the pair of second sound generation devices 1800' are substantially similar to the descriptions given above with reference to the examples of FIGS. 13C and 13D, and thus, are omitted. Also, descriptions given above with reference to the examples of FIGS. 18A to 18C may be similarly applied to the example of FIG. 13D. Descriptions of the first partition, the second partition, the third partition, the bent portion, the protrusion portion, and the second protrusion in the examples of FIGS. 18A to 18C are substantially similar to descriptions given above with reference to the examples of FIGS. 17A to 17C, and thus, are omitted.

Figure 19A:
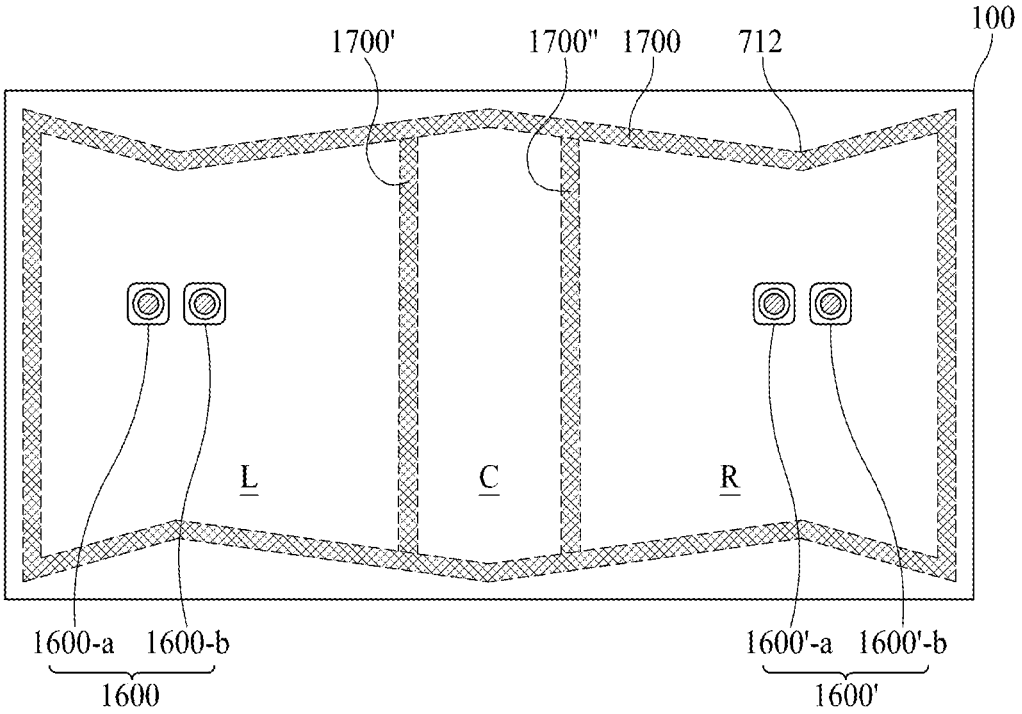
FIGS. 19A to 19C illustrate examples of a sound generation device and a partition, in a display apparatus according to an embodiment of the present disclosure.
Figure 19B:
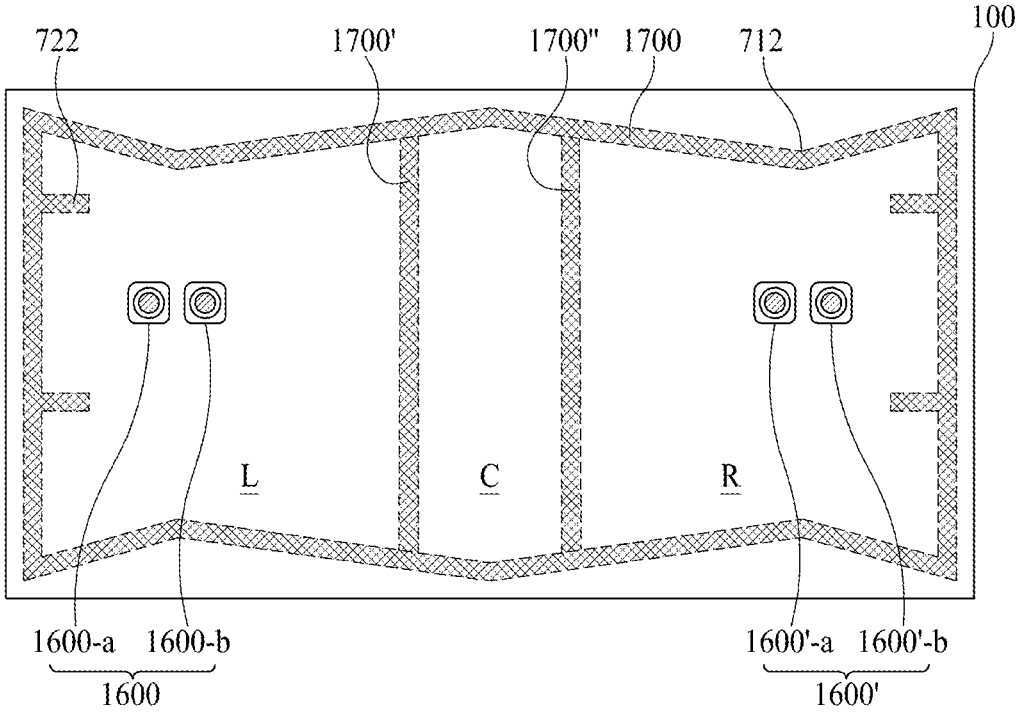
Figure 19C:
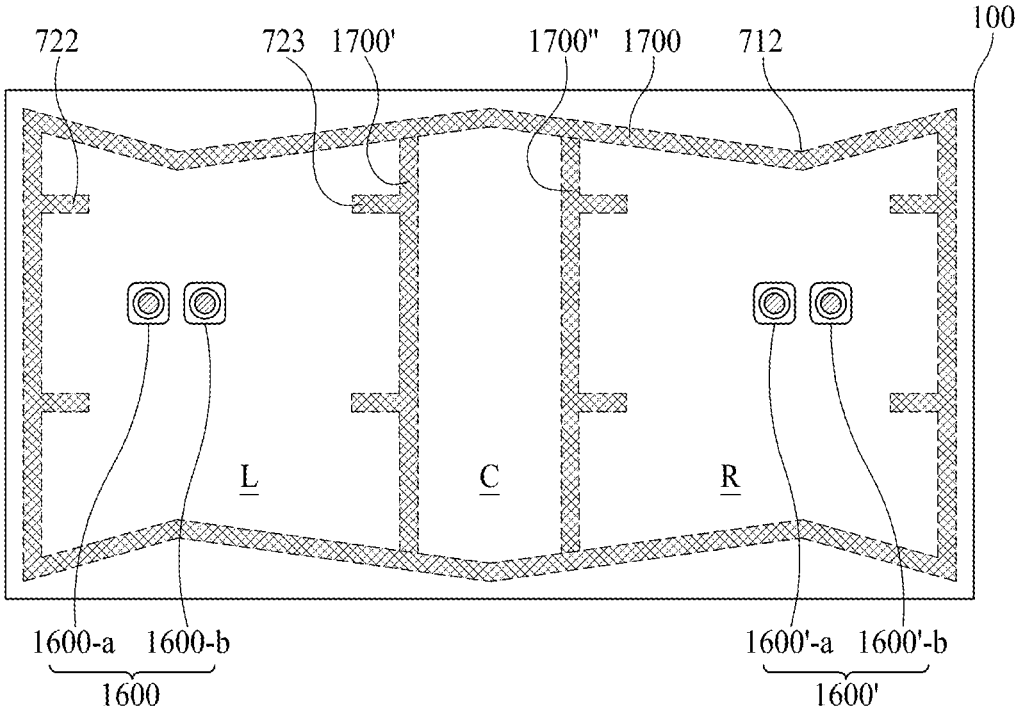

FIGS. 19A to 19C illustrate examples of a sound generation device and a partition in a display apparatus according to an embodiment of the present disclosure.

With reference to the examples of FIGS. 19A to 19C, a rear surface of a display panel 100 may include a first region L, a second region R, and a third region C. The first region L may be a left region of the rear surface of the display panel 100, the second region R may be a right region of the rear surface of the display panel 100, and the third region C may be a center region of the rear surface of the display panel 100. Two first sound generation devices 1600 may be in the first region L of the rear surface of the display panel 100, and two second sound generation devices 1600' may be in the second region R of the rear surface of the display panel 100. Also, the first sound generation device 1600 and the second sound generation device 1600' may be spaced apart from each other by a particular interval. The number of sound generation devices is not limited to two, and three or more sound generation devices may be provided.

The first sound generation device 1600 may include a 1-1$^{st}$ sound generation device 1600-*a* and a 1-2$^{nd}$ sound generation device 1600-*b*. The 1-1$^{st}$ sound generation device 1600-*a* and the 1-2$^{nd}$ sound generation device 1600-*b* may each include a first sound generator and a second sound generator. The first sound generator included in each of the 1-1$^{st}$ sound generation device 1600-*a* and the 1-2$^{nd}$ sound generation device 1600-*b* may include a magnetic circuit, and the second sound generator included in each of the 1-1$^{st}$ sound generation device 1600-*a* and the 1-2$^{nd}$ sound generation device 1600-*b* may include a magnetic circuit or a piezoelectric vibrator. Description relevant thereto is substantially similar to the description given above with reference to the examples of FIGS. 10 and 11, and thus, is omitted.

Moreover, the second sound generation device 1600' may include a 1-1$^{st}$ sound generation device 1600'-*a* and a 1-2$^{nd}$ sound generation device 1600'-*b*. The 1-1$^{st}$ sound generation device 1600'-*a* and the 1-2$^{nd}$ sound generation device 1600'-*b* may each include a first sound generator and a second sound generator. The first sound generator included in each of the 1-1$^{st}$ sound generation device 1600'-*a* and the 1-2$^{nd}$ sound generation device 1600'-*b* may include a magnetic circuit, and the second sound generator included in each of the 1-1$^{st}$ sound generation device 1600'-*a* and the 1-2$^{nd}$ sound generation device 1600'-*b* may include a magnetic circuit or a piezoelectric vibrator.

Description relevant thereto is substantially similar to the description given above with reference to the examples of FIGS. 10 and 11, and thus, is not repeated. Moreover, the descriptions given above with reference to the examples of FIGS. 19A to 19C may be similarly applied to the examples of FIGS. 13B and 13D. Descriptions of the first partition, the second partition, the third partition, the bent portion, the protrusion portion, and the second protrusion portion in the examples of FIGS. 19A to 19C are substantially similar to the descriptions given above with reference to the examples of FIGS. 17A to 17C, and thus, are not repeated.

A display panel including the sound generation device according to an embodiment of the present disclosure may use any type of display panel, such as a liquid crystal display panel, an organic light emitting diode (OLED) display panel, a quantum dot display panel, and an electroluminescent display panel, but embodiments are not limited to these examples. A display panel including the sound generation device according to an embodiment of the present disclosure may be any display panel that emits light and is vibrated (or directly vibrated) by the sound generation device to generate sound. For example, the sound generation device according to an embodiment of the present disclosure may be applied to a display panel including an organic light emitting layer, a quantum dot light emitting layer, a micro light emitting diode, etc.

Moreover, the sound generation device according to an embodiment of the present disclosure may be applied as a sound generation device provided in a display apparatus. The display apparatus according to an embodiment of the present disclosure may be applied to mobile devices, video phones, smart watches, watch phones, wearable devices, foldable devices, rollable devices, bendable devices, flexible devices, curved devices, portable multimedia players (PMPs), personal digital assistants (PDAs), electronic organizers, desktop personal computers (PCs), laptop PCs, netbook computers, workstations, navigation devices, automotive navigation devices, automotive display devices, televisions (TVs), notebook computers, monitors, cameras, camcorders, home appliances, etc. The sound generation device according to an embodiment of the present disclosure may be applied to organic light-emitting lighting apparatuses or inorganic light-emitting lighting apparatuses. When the sound generation device is applied to a lighting apparatus, the sound generation device may act as both lighting and a speaker.

A display apparatus according to an embodiment of the present disclosure will be described below.

According to an embodiment of the present disclosure, a display apparatus may include: a display panel configured to display an image by emitting light, a supporting member configured to support a rear surface of the display panel, a partition between the display panel and the supporting member, and a sound generation device, the sound generation device being configured to vibrate the display panel to generate sound, the sound generation device including: a first sound generator on the rear surface of the display panel, and a second sound generator in the first sound generator.

For example, in the display apparatus according to an embodiment of the present disclosure, the first sound generator may include a magnetic circuit. For example, in the display apparatus according to an embodiment of the present disclosure, the second sound generator may include one or more of: a magnetic circuit and a piezoelectric vibrator.

For example, in the display apparatus according to an embodiment of the present disclosure, the second sound generator and the first sound generator may be on a same axis. For example, in the display apparatus according to an embodiment of the present disclosure, a diameter of the second sound generator may be less than a diameter of the first sound generator. For example, in the display apparatus according to an embodiment of the present disclosure, the second sound generator may be over a center of the first sound generator.

For example, in the display apparatus according to an embodiment of the present disclosure, at least one of the first sound generator and the second sound generator may include: a magnet and a center pole on a plate, a bobbin near the center pole, and a coil around the bobbin. For example, in the display apparatus according to an embodiment of the present disclosure, at least one of the first sound generator and the second sound generator may include: a magnet and a center pole on a plate, a bobbin near the center pole, and a coil around the bobbin. For example, if the first sound generator includes a bobbin, the second sound generator may be over a center of the bobbin of the first sound generator.

For example, in the display apparatus according to an embodiment of the present disclosure, the first sound generator may be configured to generate sound having a low-pitched sound band, and the second sound generator may be configured to generate sound having a high-pitched sound band. For example, in the display apparatus according to an embodiment of the present disclosure, the display panel may include: a first side and a second side perpendicular to the first side, and the first sound generator and the second sound generator may be parallel to the first side or the second side.

For example, in the display apparatus according to an embodiment of the present disclosure, each of the first sound generator and the second sound generator may include one of: a circular shape, an oval shape, a track shape, and a tetragonal shape. For example, in the display apparatus according to an embodiment of the present disclosure, the sound generation device may include one or more of: a pair of sound generation devices, and two or more sound generation devices.

According to an embodiment of the present disclosure, a display apparatus may include: a display panel configured to display an image by emitting light, the display panel including: a first region, a second region, and a third region, a supporting member configured to support a rear surface of the display panel, and at least one sound generation device including: a first sound generator in at least one of the first region, the second region, and the third region, and a second sound generator in the first sound generator.

For example, in the display apparatus according to an embodiment of the present disclosure, the first sound generator may include a magnetic circuit. For example, in the display apparatus according to an embodiment of the present disclosure, the second sound generator may include one or more of: a magnetic circuit and a piezoelectric vibrator.

For example, in the display apparatus according to an embodiment of the present disclosure, the second sound generator and the first sound generator may be on a same axis. For example, in the display apparatus according to an embodiment of the present disclosure, the first region may be a left region of the display panel, the second region may be a right region of the display panel, and the third region may be a center region of the display panel.

For example, the display apparatus according to an embodiment of the present disclosure may further include at least one first partition between the first region and the third region, and at least one second partition between the second region and the third region. For example, the display apparatus according to an embodiment of the present disclosure may further include at least one first partition between the first region and the third region, at least one second partition between the second region and the third region, and a third partition in a periphery of the display panel or the supporting member. For example, in the display apparatus according to an embodiment of the present disclosure, the third partition may include one or more of: a bent portion that may be bent toward the at least one sound generation device, and one or more protrusion portions on at least one side of the third partition.

For example, the display apparatus according to an embodiment of the present disclosure may further include a partition in a periphery of the display panel or the supporting member. For example, the display apparatus according to an embodiment of the present disclosure may further include a partition in a periphery of the display panel or the supporting member, the partition including a bent portion that may be bent toward the at least one sound generation device. For example, the display apparatus according to an embodiment of the present disclosure may further include a partition in a periphery of the display panel or the supporting member, the partition including: a bent portion that may be bent toward the at least one sound generation device, and one or more protrusion portions on at least one side of the third partition.

For example, in the display apparatus according to an embodiment of the present disclosure, the at least one sound generation device may include one or more of: a pair of sound generation devices, and two or more sound generation devices. For example, in the display apparatus according to an embodiment of the present disclosure, the second sound generator may be over a center of the first sound generator.

For example, in the display apparatus according to an embodiment of the present disclosure, at least one of the first sound generator or the second sound generator may include: a magnet and a center pole on a plate, a bobbin near the center pole, and a coil around the bobbin. For example, if the first sound generator includes a bobbin, the second sound generator may be over a center of the bobbin of the first sound generator.

For example, in the display apparatus according to an embodiment of the present disclosure, the first sound generator may be configured to generate sound having a low-pitched sound band, and the second sound generator may be configured to generate sound having a high-pitched sound band.

As described above, when the display apparatus according to the embodiments of the present disclosure includes the sound generation device that vibrates the display panel to generate sound, the sound of the display apparatus may be output to a front portion of the display panel. Accordingly, an immersion experience of a viewer watching an image displayed by the display apparatus may be enhanced.

When the display apparatus according to the embodiments of the present disclosure includes the sound generation device that vibrates the display panel to generate sound. Thus, a separate speaker may not be provided, enabling improvements on the degree of freedom in the design of the set apparatus as it relates to disposition of the speaker.

When the display apparatus according to the embodiments of the present disclosure, the supporting member may be fixed to the sound generation device by using a nut and a screw in the supporting member, thereby decreasing a thickness of the display panel. In the display apparatus according to the embodiments of the present disclosure, because the supporting member may be formed of glass or stainless steel, an appearance design of the display apparatus may be enhanced.

Moreover, according to the embodiments of the present disclosure, the first sound generator and the second generator having a diameter less than that of the first sound generator may be provided, thereby providing a display apparatus including a sound generation device having a smaller size. Moreover, according to the embodiments of the present disclosure, the first sound generator and the second generator having a diameter less than that of the first sound generator may be provided, thereby providing a display apparatus having a reduced size.

Moreover, according to the embodiments of the present disclosure, the first sound generator for outputting a sound having the low-pitched sound band and the second generator for outputting a sound having the high-pitched sound band may be provided, thereby providing a display apparatus for outputting an enhanced sound having the high-pitched sound band. Moreover, according to the embodiments of the present disclosure, the first sound generator for outputting a sound having the low-pitched sound band and the second generator for outputting a sound having the high-pitched sound band may be disposed on the same axis, thereby providing a display apparatus for generating sound having the high-pitched sound band and the same phase.

In the display apparatus according to the embodiments of the present disclosure, when the partition is between one or more sound generation devices on the display panel, the partition may separate a sound. Thus, a stereo sound may be realized. Accordingly, a display apparatus having an enhanced sound output characteristic may be implemented.

Moreover, when the display apparatus according to the embodiments of the present disclosure includes the partition including the bent portion or the protrusion portion, sound quality may be reduced or prevented from being reduced by the standing wave or the reflected wave in the display panel. Accordingly, a display apparatus having an enhanced sound output characteristic may be implemented.

It will be apparent to those skilled in the art that various modifications and variations may be made in the present disclosure without departing from the technical idea or scope of the disclosure. Thus, it may be intended that embodiments of the present disclosure cover the modifications and variations of the disclosure provided they come within the scope of the appended claims and their equivalents.

What is claimed is:

1. A display apparatus, comprising:
- a display panel configured to display an image by emitting light;
- a supporting member configured to support a rear surface of the display panel;
- a partition between the display panel and the supporting member; and
- a sound generation device configured to vibrate the display panel to generate sound, the sound generation device comprising:
  - a first sound generator on the rear surface of the display panel; and
  - a second sound generator in the first sound generator.

2. The display apparatus of claim 1, wherein the first sound generator comprises a magnetic circuit.

3. The display apparatus of claim 1, wherein the second sound generator comprises one or more of: a magnetic circuit and a piezoelectric vibrator.

4. The display apparatus of claim 1, wherein the second sound generator and the first sound generator are on a same axis.

5. The display apparatus of claim 1, wherein a diameter of the second sound generator is less than a diameter of the first sound generator.

6. The display apparatus of claim 1, wherein the second sound generator is over a center of the first sound generator.

7. The display apparatus of claim 1, wherein at least one of the first sound generator and the second sound generator comprises:
- a magnet and a center pole on a plate;
- a bobbin near the center pole; and
- a coil around the bobbin.

8. The display apparatus of claim 1, wherein:
- at least one of the first sound generator and the second sound generator comprises:
  - a magnet and a center pole on a plate;
  - a bobbin near the center pole; and
  - a coil around the bobbin; and
- if the first sound generator comprises a bobbin, the second sound generator is over a center of the bobbin of the first sound generator.

9. The display apparatus of claim 1, wherein:
- the first sound generator is configured to generate sound having a low-pitched sound band; and
- the second sound generator is configured to generate sound having a high-pitched sound band.

10. The display apparatus of claim 1, wherein:
- the display panel comprises:
  - a first side; and
  - a second side perpendicular to the first side; and
- the first sound generator and the second sound generator are parallel to the first side or the second side.

11. The display apparatus of claim 1, wherein each of the first sound generator and the second sound generator comprises one of: a circular shape, an oval shape, a track shape, and a tetragonal shape.

12. The display apparatus of claim 1, wherein the sound generation device comprises one or more of:
- a pair of sound generation devices; and
- two or more sound generation devices.

13. A display apparatus, comprising:
- a display panel configured to display an image by emitting light, the display panel comprising:
  - a first region;
  - a second region; and
  - a third region;
- a supporting member configured to support a rear surface of the display panel; and
- at least one sound generation device comprising:
  - a first sound generator in at least one of the first region, the second region, and the third region; and
  - a second sound generator in the first sound generator.

14. The display apparatus of claim 13, wherein the first sound generator comprises a magnetic circuit.

15. The display apparatus of claim 13, wherein the second sound generator comprises one or more of: a magnetic circuit and a piezoelectric vibrator.

16. The display apparatus of claim 13, wherein the second sound generator and the first sound generator are on a same axis.

17. The display apparatus of claim 13, wherein:
- the first region is a left region of the display panel;
- the second region is a right region of the display panel; and
- the third region is a center region of the display panel.

18. The display apparatus of claim 13, further comprising:

at least one first partition between the first region and the third region; and at least one second partition between the second region and the third region.

19. The display apparatus of claim 13, further comprising:

at least one first partition between the first region and the third region;

at least one second partition between the second region and the third region; and a third partition in a periphery of the display panel or the supporting member.

20. The display apparatus of claim 19, wherein the third partition comprises one or more of:

a bent portion that is bent toward the at least one sound generation device; and one or more protrusion portions on at least one side of the third partition.

21. The display apparatus of claim 13, further comprising a partition in a periphery of the display panel or the supporting member.

22. The display apparatus of claim 13, further comprising a partition in a periphery of the display panel or the supporting member, the partition including a bent portion that is bent toward the at least one sound generation device.

23. The display apparatus of claim 13, further comprising a partition in a periphery of the display panel or the supporting member, the partition comprising:

a bent portion that is bent toward the at least one sound generation device; and one or more protrusion portions on at least one side of the third partition.

24. The display apparatus of claim 13, wherein the at least one sound generation device comprises one or more of:

a pair of sound generation devices; and two or more sound generation devices.

25. The display apparatus of claim 13, wherein the second sound generator is over a center of the first sound generator.

26. The display apparatus of claim 13, wherein:

at least one of the first sound generator or the second sound generator comprises:

a magnet and a center pole on a plate;

a bobbin near the center pole; and a coil around the bobbin; and if the first sound generator comprises a bobbin, the second sound generator is over a center of the bobbin of the first sound generator.

27. The display apparatus of claim 13, wherein:

the first sound generator is configured to generate sound having a low-pitched sound band; and the second sound generator is configured to generate sound having a high-pitched sound band.

* * * * *